US011970872B2

(12) United States Patent
Behrbohm

(10) Patent No.: US 11,970,872 B2
(45) Date of Patent: Apr. 30, 2024

(54) POST CONNECTION ADAPTER

(71) Applicant: Wilhelm Layher Verwaltungs-GmbH, Gueglingen-Eibensbach (DE)

(72) Inventor: Wolf Christian Behrbohm, Besigheim-Ottmarsheim (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 967 days.

(21) Appl. No.: 16/960,456

(22) PCT Filed: Jan. 15, 2019

(86) PCT No.: PCT/DE2019/100033
§ 371 (c)(1),
(2) Date: Jul. 7, 2020

(87) PCT Pub. No.: WO2019/161825
PCT Pub. Date: Aug. 29, 2019

(65) Prior Publication Data

US 2020/0332537 A1 Oct. 22, 2020

(30) Foreign Application Priority Data

Feb. 21, 2018 (DE) ..... 10 2018 103 898.4

(51) Int. Cl.
*E04G 5/04* (2006.01)
*E04G 7/32* (2006.01)
(Continued)

(52) U.S. Cl.
CPC ..... *E04G 5/045* (2013.01); *E04G 7/32* (2013.01); *E04G 5/16* (2013.01);
(Continued)

(58) Field of Classification Search
CPC .. E04G 5/045; E04G 7/32; E04G 5/16; E04G 7/22; E04G 7/26; E04G 2007/005;
(Continued)

(56) References Cited

U.S. PATENT DOCUMENTS 5,107,959 A 4/1992 Lubinski
9,109,370 B2 * 8/2015 Kreller ..... E04G 7/301
(Continued)

FOREIGN PATENT DOCUMENTS

DE 200 12 598 U1 9/2000
DE 10 2011 001 796 A1 10/2012
(Continued)

OTHER PUBLICATIONS

International Search Report in PCT/DE2019/100033, mailed Apr. 29, 2019.
(Continued)

*Primary Examiner* — Bradley Duckworth
(74) *Attorney, Agent, or Firm* — Collard & Roe, P.C.

(57) ABSTRACT

A post connection adapter for detachably fastening a scaffolding post to a support includes a fastening body having first and second fastening-body fasteners in first and second fastening-body fastening positions, respectively, and detachably fastenable to the support selectively by the first or second fastener. The first and second positions have a fastening position distance between each other of 72 mm. The post connection adapter includes a post connection body extending toward the post connection body axis and fastened to the fastening body. An imaginary center plane containing an imaginary center point between the first and second positions is offset by 20 mm perpendicular to the center plane and to the post connection body axis, with respect to a post connection body axis plane extending parallel to the center plane and containing the post connection body axis.
(Continued)

A device has two identical post connection adapters detachably fastened to a support.

12 Claims, 9 Drawing Sheets

(51) Int. Cl.

| | |
|---|---|
| *E04G 5/16* | (2006.01) |
| *E04G 7/00* | (2006.01) |
| *E04G 7/22* | (2006.01) |
| *E04G 7/26* | (2006.01) |

(52) U.S. Cl.
CPC ..... *E04G 2007/005* (2013.01); *E04G 7/22* (2013.01); *E04G 7/26* (2013.01)

(58) Field of Classification Search
CPC ..... E04G 3/22; E04G 5/165; E04G 1/152; E04G 1/04; E04G 21/32; E04G 3/04; E04G 21/3219; E04G 21/3214; E04G 21/3285; E04G 5/041
USPC ..... 248/200
See application file for complete search history.

(56) References Cited

U.S. PATENT DOCUMENTS

| | | | | |
|---|---|---|---|---|
| 10,100,508 | B1 * | 10/2018 | Fox | E04B 1/2608 |
| 2007/0056802 | A1 * | 3/2007 | Taberah | E04G 1/20 182/141 |
| 2007/0062761 | A1 * | 3/2007 | Megna | E04G 3/26 182/45 |
| 2010/0025556 | A1 * | 2/2010 | Rogers | E04G 7/301 248/296.1 |
| 2022/0325539 | A1 * | 10/2022 | Neuwirth | E04G 5/045 |

FOREIGN PATENT DOCUMENTS

| | | | |
|---|---|---|---|
| DE | 10 2016 103 224 | A1 | 8/2017 |
| EP | 3 147 424 | A2 | 3/2017 |
| GB | 2 350 393 | A | 11/2000 |
| GB | 2 354 790 | A | 4/2001 |
| WO | 98/26141 | A1 | 6/1998 |
| WO | 02/06610 | A1 | 1/2002 |
| WO | 2012/136198 | A1 | 10/2012 |

OTHER PUBLICATIONS

English translation of the International Preliminary Report on Patentability and Written Opinion of the International Searching Authority in PCT/DE2019/100033, mailed Aug. 27, 2020.

* cited by examiner

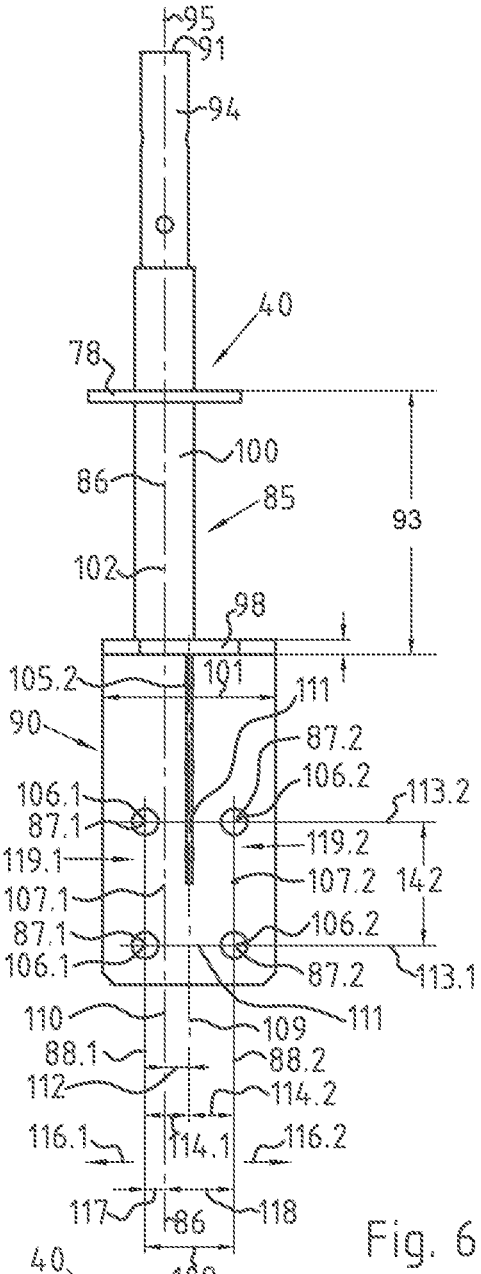
Fig. 6.1
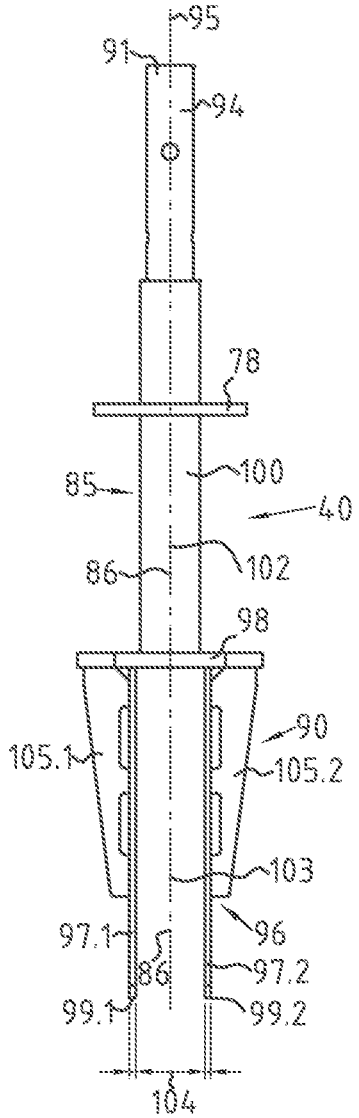
Fig. 6.2
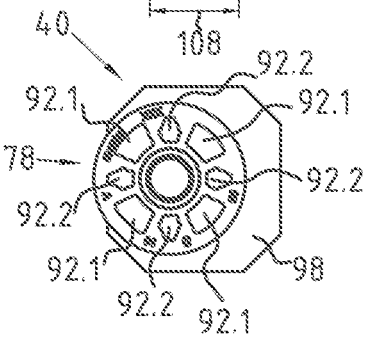
Fig. 6.3

POST CONNECTION ADAPTER

CROSS REFERENCE TO RELATED APPLICATIONS

This application is the National Stage of PCT/DE2019/100033 filed on Jan. 15, 2019, which claims priority under 35 U.S.C. § 119 of German Application No. 10 2018 103 898.4 filed on Feb. 21, 2018, the disclosure of which is incorporated by reference. The international application under PCT article 21(2) was not published in English.

The invention relates to a post connection adapter for detachable fastening of a post for scaffolding to a beam. The invention also relates to a device for detachable fastening of posts for scaffolding of a scaffolding system or a modular scaffolding system, in particular of the Applicant, comprising a first post connection adapter according to the invention and a second post connection adapter according to the invention.

The Applicant has sold for many decades in large numbers a modular scaffolding system in which the post axes of the scaffolding posts are to be incorporated parallel to one another at specific system axial spacings. For this purpose, a number of scaffolding bars in different system lengths is offered, which each have at the bar ends thereof connection heads which are each provided with a slot for plugging onto apertured discs of the scaffolding posts and are detachably fixable to the scaffolding posts by means of the connection heads by way of a respective wedge via the apertured discs of the scaffolding posts. Scaffolding posts of that kind are disclosed in, for example, DE 10 2011 001 796 A1 or in the parallel WO 2012/136198 A1. The apertured discs usually have eight passage holes which are respectively arranged to be offset relative to one another at a circumferential angle of 45 degrees. Apertured discs of that kind are disclosed in, for example, DE 200 12 598 U1 or the parallel WO 02/06610 A1. The scaffolding posts for construction of modular scaffolding are provided with several apertured discs which are fastened by welding to the respective scaffolding post at equal mutual spacings corresponding with a pitch dimension. The system lengths of the scaffolding bars are indicated in the form of thereby-realisable system axial dimensions which refer to the axial spacings of the parallel post axes of two adjacent scaffolding posts. The scaffolding bars, which are most frequent with respect to number, for the modular scaffolding of the Applicant relate to system axial dimensions which can be realised by that of 732 millimetres, 1088 millimetres, 1572 millimetres, 2072 millimetres, 2772 millimetres and 3072 millimetres.

Scaffolding beams of other manufacturers are frequently offered and have several beam fastening bores for the fastening of further scaffolding components, wherein the fastening bores are arranged at identical mutual spacings which have integral number dimensions in centimetres. These spacings can be 10 centimetres or an integral number multiple of 10 centimetres. In practice these spacings are also termed "metric spacings".

If modular scaffolding of the Applicant is now to be fastened to scaffolding beams of that kind at the principally relevant system axial dimensions at the beam fastening bores or if the scaffolding posts of the modular scaffolding of the Applicant are to be fastened to scaffolding beams at the principally relevant system axial dimensions in such a way that the beam fastening positions can be realised at spacings of 10 centimetres or a whole-number multiple of 10 centimetres it is necessary to undertake suitable adaptation measures for that purpose. For that purpose it would be conceivable to use coupling adapters which are frictionally and detachably connectible with the scaffolding beam. However, this would be problematic from the static aspect and above all would be more expensive, because the spacings would have to be measured. It would also be conceivable to provide connection adapters which are provided with slots through which screws are insertable, which are in turn insertable through beam fastening bores of the scaffolding beam and would be securable by means of nuts. In this way the connection adapters could be displaced relative to the scaffolding beam within the limits predetermined by the slots until the desired system axial dimension is achieved, whereupon the screw connection would then be tightened. A solution of that kind would also be problematic from the static aspect and also expensive, because here, too, the spacings would have to be measured.

It is accordingly an object of the invention to make available a post connection adapter and a device of the kind stated in the introduction by which scaffolding posts can be so detachably fastenable preferably to a beam having beam fastening means, the beam fastening positions of which have mutual spacings of 10 centimetres or an integral number multiple of 10 centimetres, that the post axes thereof are mountable parallel to one another at principal system axial spacings, particularly of the Applicant, and which offer statically advantageous fastening possibilities.

The object of the invention is fulfilled with respect to the post connection adapter by the features of claim 1. Accordingly, the invention relates to a post connection adapter for detachable fastening of a post for scaffolding to a beam which has a plurality of beam fastening positions, which are arranged at the same beam fastening position spacings of 100 millimetres or a whole-number multiple of 100 millimetres from one another, of beam fastening means and/or for detachable fastening to a post, which extends in the direction of the post axis thereof, of scaffolding, comprising a fastening body, which at a first fastening-body fastening position has a first fastening-body fastening means for detachable fastening of the fastening body at a beam fastening position of the beam fastening positions of a beam fastening means of the beam fastening means of a beam or of the beam, and which at a second fastening-body fastening position has a second fastening-body fastening means for detachable fastening of the fastening body at a beam fastening position of the beam fastening positions of a beam fastening means of the beam fastening means of a beam or of the beam, and which is detachably fastenable or to be detachably fastened to a beam or of the beam selectably either by way of the first fastening-body fastening means or by way of the second fastening-body fastening means at a beam fastening position of the beam fastening positions of a beam or of the beam and comprising a post connection body, which is preferably formed by a tube or as a tube and which extends, preferably rectilinearly, in the direction of the post connection body axis thereof, for detachable fastening of a post for scaffolding, which is fastened, preferably rigidly, to the fastening body and which has a post connection body end extending away from the fastening body, wherein the first fastening-body fastening position and the second fastening-body fastening position have a fastening position spacing from one another of 72 millimetres, and wherein a notional centre plane, which contains a notional centre point in the centre between the first fastening-body fastening position and the second fastening-body fastening position, is arranged to be offset at a spacing of 20 millimetres from a notional post connection body axial plane, which extends parallel to the notional centre plane and contains the post connection body axis, as considered in a direction perpendicular to the notional centre plane and perpendicular to the post connection body axis. It is thereby achieved that the first fastening-body fastening position of the first fastening-body fastening means has a first spacing from the post connection body axial plane of 16 millimetres and that the second fastening-body fastening position of the second fastening-body fastening means has a second spacing from the post connection body axial plane of 56 millimetres.

According to a particularly advantageous embodiment it can be provided that the fastening body has at a further first fastening-body fastening position a further first fastening-body fastening means for detachable fastening of the fastening body at a beam fastening position of a beam fastening means of a beam or of the beam, wherein the further first fastening-body fastening position of the further first fastening-body fastening means and the first fastening-body fastening position of the first fastening-body fastening means as considered in the direction of the post connection body axis are arranged at a first fastening-body fastening means spacing from one another and each in a notional first fastening-body fastening position plane extending parallel to the notional centre plane, and that the fastening body has at a further second fastening-body fastening position a further second fastening-body fastening means for detachable fastening of the fastening body at a beam fastening position of a beam fastening means of a beam or the beam, wherein the further second fastening-body fastening position of the further second fastening-body fastening means and the second fastening-body fastening position of the second fastening-body fastening means as considered in the direction of the post connection body axis are arranged at a second fastening-body fastening means spacing from one another and each in a notional second fastening-body fastening position plane extending parallel to the notional centre plane, wherein the second fastening-body fastening means spacing is the same size as the first fastening-body fastening means spacing. A more secure and stable fastening as well as orientation of the post connection adapter can thereby be achieved.

According to a preferred embodiment it can be provided that the fastening body is formed with a U profile member, which is open in a direction away from the post connection body end and towards sides facing away from one another, the parallel U profile member limbs of which have a mutual limb spacing as considered in a direction perpendicular to the post connection body axis, and that a first U profile member limb of the U profile member limbs includes the first fastening-body fastening means and the second fastening-body fastening means or the at least two first fastening-body fastening means and the at least two second fastening-body fastening means and that a second U profile member limb of the U profile member limbs includes corresponding or the same fastening-body fastening means at corresponding or the same fastening-body fastening positions. As a result, an even more secure and stable fastening as well as orientation of the post connection adapter and a simplified mounting can be achieved.

According to an advantageous development it can be provided that the post connection body comprises a tube, the tube axis of which is aligned with the post connection body axis, wherein a rosette or apertured disc, which surrounds the outer circumference of the tube at least partly or entirely, for detachable connection of scaffolding components such as longitudinal bars, transverse bars or diagonals, is fastened to the tube, preferably by welding. As a result, the post connection adapter can be integrated particularly advantageously in a modular scaffolding, especially of the Applicant, and expanded possibilities of use and connection are created.

According to a preferred development it can be provided that the post connection body comprises a tube connector for insertion or plugging-on of a post for scaffolding, the tube connector axis of which is aligned with the post connection body axis and which extends in the direction of its tube connector axis up to the post connection body end. As a result mounting of a post can be improved and a particularly stable connection with a post created.

According to a particularly preferred embodiment it can be provided that the or each first fastening-body fastening means and the or each second fastening-body fastening means are of the same configuration. Particularly flexible mounting possibilities with, at the same time, reduced production costs can thereby be achieved.

According to a particularly preferred variant of embodiment it can be provided that the or each first fastening-body fastening means and the or each second fastening-body fastening means are each a preferably circularly round, particularly circularly cylindrical, passage or a preferably circularly round, particularly circularly cylindrical, bore. As a result, even more flexible mounting possibilities with, at the same time, further reduced production costs can thereby be achieved.

The object of the invention is fulfilled with respect to the said device by the features of claim 8. Accordingly, the invention also relates to a device for detachable fastening of posts for scaffolding of a scaffolding system, preferably a modular scaffolding system, particularly of the Applicant, the parallel post axes of which can be or are to be arranged at mutual system axial spacings of the scaffolding system, comprising a beam which preferably extends in the beam longitudinal axis thereof, especially is elongate, and which has a plurality of beam fastening positions, which are preferably arranged along a notional straight line and arranged at the same beam fastening-position spacings from one another of 100 millimetres or a whole-number multiple of 100 millimetres, of beam fastening means and comprising a first post connection adapter according to the invention, particularly according to any one of claims 1 to 7, and a second post connection adapter according to the invention, particularly according to any one of claims 1 to 7, which is of the same configuration as the first post connection adapter, of which each post connection adapter is selectably detachably fastened by way of at least one fastening-body fastening means of its fastening-body fastening means of its fastening body in each instance at another beam fastening position of the beam fastening positions of the beam as follows:

a) by way of the first fastening-body fastening means of the first post connection adapter and by way of the first fastening-body fastening means of the second post connection adapter in such a way that the post connection body axis of the first post connection adapter and the post connection body axis, which extends parallel thereto, of the second post connection adapter have a mutual post connection body axial spacing which is larger by 32 millimetres or smaller by 32 millimetres than a fastening-position spacing of the first fastening-body fastening position of the first fastening-body fastening means of the first post connection adapter from the first fastening-body fastening position of the first fastening-body fastening means of the second post connection adapter, or;

b) by way of the second fastening-body fastening means of the first post connection adapter and by way of the second fastening-body fastening means of the second post connection adapter in such a way that the post connection body axis of the first post connection adapter and the post connection body axis, which extends parallel thereto, of the second post connection adapter have a mutual post connection body axial spacing which is larger by 112 millimetres or smaller by 112 millimetres than a fastening-position spacing of the second fastening-body fastening position of the second fastening-body fastening means of the first post connection adapter from the second fastening-body fastening position of the second fastening-body fastening means of the second post connection adapter, or;

c) by way of the first fastening-body fastening means of the first post connection adapter and by way of the second fastening-body fastening means of the second post connection adapter in such a way that the post connection body axis of the first post connection adapter and the post connection body axis, which extends parallel thereto, of the second post connection adapter have a mutual post connection body axial spacing which is larger by 72 millimetres or smaller by 72 millimetres than a fastening-position spacing of the first fastening-body fastening position of the first fastening-body fastening means of the first post connection adapter from the second fastening-body fastening position of the second fastening-body fastening means of the second post connection adapter, or by way of the first fastening-body fastening means of the second post connection adapter and by way of the second fastening-body fastening means of the first post connection adapter in such a way that the post connection body axis of the first post connection adapter and the post connection body axis, which extends parallel thereto, of the second post connection adapter have a mutual post connection body axial spacing which is larger by 72 millimetres or smaller by 72 millimetres than a fastening-position spacing of the second fastening-body fastening position of the second fastening-body fastening means of the first post connection adapter from the first fastening-body fastening position of the first fastening-body fastening means of the second post connection adapter, or;

d) by way of the first fastening-body fastening means of the first post connection adapter and by way of the second fastening-body fastening means of the second post connection adapter in such a way that the post connection body axis of the first post connection adapter and the post connection body axis, which extends parallel thereto, of the second post connection adapter have a mutual post connection body axial spacing which is larger by 40 millimetres or smaller by 40 millimetres than a fastening-position spacing of the first fastening-body fastening position of the first fastening-body fastening means of the first post connection adapter from the second fastening-body fastening position of the second fastening-body fastening means of the second post connection adapter, or by way of the first fastening-body fastening means of the second post connection adapter and by way of the second fastening-body fastening means of the first post connection adapter in such a way that the post connection body axis of the first post connection adapter and the post connection body axis, which extends parallel thereto, of the second post connection adapter have a mutual post connection body axial spacing which is larger by 40 millimetres or smaller by 40 millimetres than a fastening-position spacing of the second fastening-body fastening position of the second fastening-body fastening means of the first post connection adapter from the first fastening-body fastening position of the first fastening-body fastening means of the second post connection adapter.

According to which of the principal alternatives a) to d) and which of the sub-alternatives therein are selected for the fastening arrangement of the two post connection adapters at the beam the spacing direction of the selected fastening-body fastening position of the first post connection adapter and the spacing direction of the selected fastening-body fastening position of the second post connection adapter are oriented either in the same direction or in opposite directions. According to the invention this can be achieved in that the respective post connection adapters, depending on which of the said alternatives or fastening arrangements is to be achieved, either are fastened to the beam in a first orientation or are fastened to the beam in a second orientation rotated relative to the beam and relative to the other post connection adapters through 180 degrees about the post connection body axis thereof. Depending on which of the said alternatives or fastening arrangements is selected, in this mode and manner the axial spacings principally used in practice, thus all principal system axial dimensions, of parallel post axes of adjacent posts of a scaffolding system, particularly a modular scaffolding system, of the Applicant can be realised in order to detachably fasten corresponding posts and/or system bars to a beam. According to the invention this can be realised in each instance with post connection adapters of the same configuration. Consequently, all principal system axial dimensions can be realised with the same post connection adapters. As a result, substantial production costs can be saved and it is not necessary for several different post connection adapters to be handled at the construction site and appropriately selected, so that to that extent also no instances of confusion or faulty installations of post connection adapters can occur. An assembler only has to decide at the time of mounting in which orientation he or she has to fasten each post connection adapter to the beam so as to ensure a desired principal system axial dimension of the post connection body axes from two adjacent post connection adapters to be fastened to the beam.

According to a particularly preferred variant of embodiment it can be provided that in the case of each post connection adapter the fastening body has at a further first fastening-body fastening position a further first fastening-body fastening means for detachable fastening of the fastening body at a beam fastening position of a beam fastening means of the beam, wherein the further first fastening-body fastening position of the further first fastening-body fastening means and the first fastening-body fastening position of the first fastening-body fastening means as considered in the direction of the post connection body axis are arranged at a first fastening-body fastening means spacing from one another and each in a notional first fastening-body fastening position plane extending parallelly to the notional centre plane, and in the case of each post connection adapter the fastening body has at a further second fastening-body fastening position a further second fastening-body fastening means for detachable fastening of the fastening body at a beam fastening position of a beam fastening means of the beam, wherein the further second fastening-body fastening position of the further second fastening-body fastening means and the second fastening-body fastening position of the second fastening-body fastening means as considered in the direction of the post connection body axis are arranged at a second fastening-body fastening means spacing from one another and each in a notional second fastening-body fastening position plane extending parallel to the notional centre plane, wherein the second fastening-body fastening means spacing is the same size as the first fastening-body fastening means spacing, and the beam fastening means are arranged in parallel longitudinal rows each along a notional straight line, which rows have a mutual longitudinal row spacing the same size as the first fastening-body fastening means spacing and the second fastening-body fastening means spacing. A more secure and stable fastening as well as orientation of the post connection adapters and more flexible mounting possibilities can thereby be achieved.

According to a preferred development it can be provided that the beam fastening means are preferably circularly round, particularly circularly cylindrical, passages or preferably circularly round, particularly circularly cylindrical, bores. As a result, more flexible mounting possibilities with, at the same time, further reduced reduction costs can thereby be achieved.

According to a particularly preferred embodiment, it can be provided that the beam fastening means have the same configuration as the fastening-body fastening means. As a result, even more flexible mounting possibilities with, at the same time, still further reduced reduction costs can be achieved.

According to a preferred embodiment it can be provided that the beam has parallel side walls which have a mutual side wall spacing and that the fastening body of the first post connection adapter and the second post connection adapter are each formed with a U profile member which is open in a direction away from the post connection body end and towards sides facing away from one another and the parallel U profile member limbs of which as considered in a direction perpendicular to the post connection body axis have a mutual limb spacing of the same size, which is slightly larger than the side wall spacing of the beam, and that each post connection adapter is plugged by its U profile member onto the beam and detachably fastened by way of its fastening-body fastening means to the beam by way of associated beam fastening means of the beam fastening means. As a result, a more secure and stable fastening as well as orientation of the post connection adapters and a simplified mounting can be achieved.

According to a preferred development it can be provided that each fastening-body fastening means is detachably connected with the associated beam fastening means by way of a connecting body. Each connecting body can preferably be a preferably substantially cylindrical bolt. This makes possible a particularly simple mounting and particularly secure and stable fastening possibilities with low production costs.

The object of the invention with respect to the said device is also fulfilled by the features of claim 14. According to that, the invention also relates to a device for detachable fastening of posts for scaffolding of a scaffolding system, comprising a first post connection adapter according to the invention, particularly according to any one of claims 1 to 7, and a second post connection adapter according to the invention, particularly according to any one of claims 1 to 7, which is of the same configuration as the first connection post adapter, wherein at least one first post, which extends in the direction of its first post axis, of the posts is detachably fastened to the post connection body of the first post connection adapter, particularly by plugging on, and wherein at least one second post, which extends in the direction of its second post axis, of the posts is detachably fastened to the post connection body of the second post connection adapter, particularly by plugging on, and wherein the first post axis of the first post and the parallel second post axis of the second post have a mutual post axial spacing which is 10 centimetres or a whole-number multiple of 10 centimetres. As a result, by means of the post connection adapters it is possible with particular advantage to fasten posts, the post axes of which are mountable parallel to one another at system axial spacings which are 10 centimetres or a whole-number multiple of 10 centimetres, to constructions, at the fastening positions of which for fastening of the fastening bodies the post connection adapters are provided at spacings corresponding with specific principal system axial dimensions, particularly of the Applicant.

According to a preferred embodiment it can be provided that the first post axis of the first post is aligned with the post connection body axis of the first post connection adapter and that the second post axis of the second post is aligned with the post connection body axis of the second post connection adapter. As a result, mounting of the posts can be improved and a particularly stable construction created.

According to a preferred development it can be provided that each post connection body comprises a tube connector for insertion or plugging-on of a post for scaffolding, the tube connector axis of which is aligned with the post connection body axis and which extends in the direction of its tube connector axis up to the post connection body end. The mounting of the post can thereby be further improved and, with further improved stability of the construction, a particularly stable connection to the posts can be created.

It will be obvious that the aforesaid measures can be combined with one another as desired within the scope of feasibility.

Further aspects, features and advantages of the invention can be inferred from the following description part, in which preferred embodiments of the invention are described on the basis of the drawings, in which.

Figure 5:
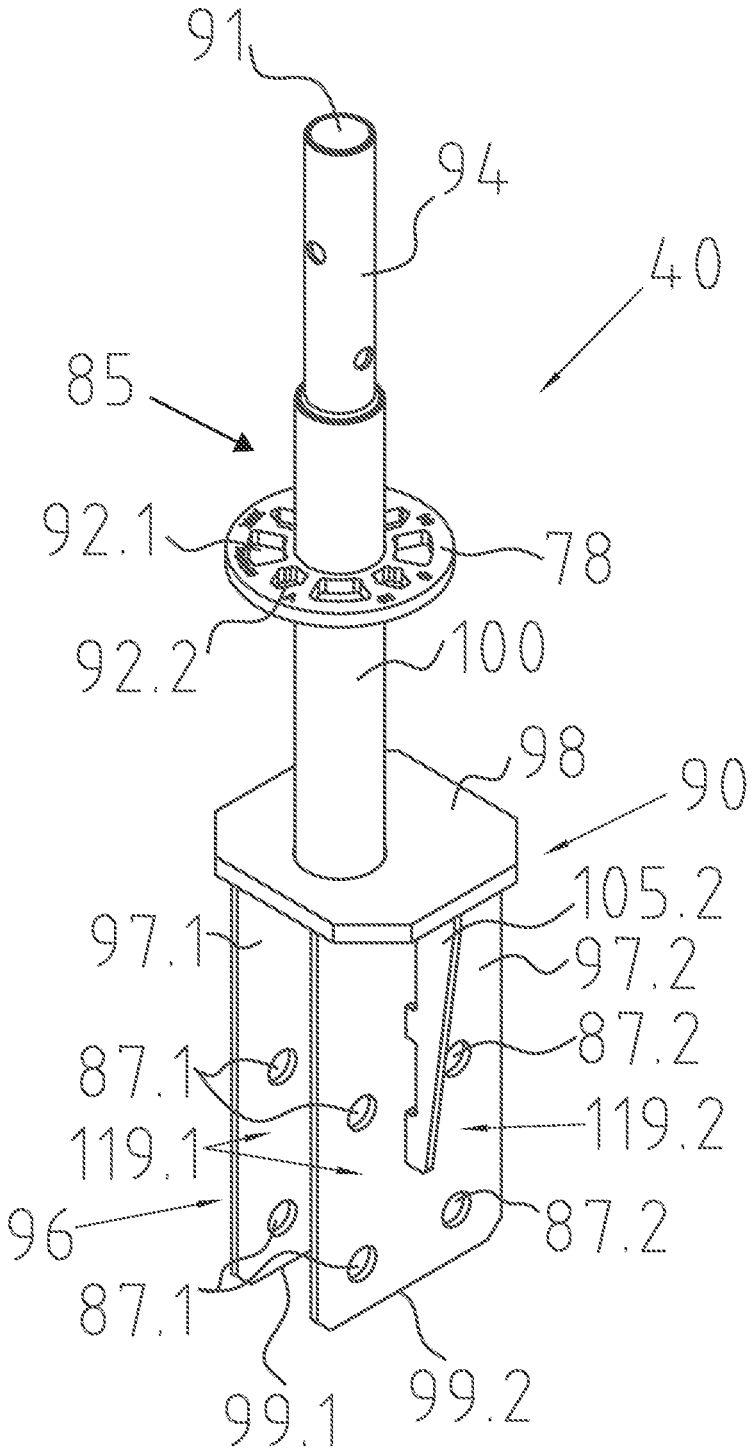
FIG. 5 shows a perspective illustration of a post connection adapter according to the invention.
Figure 7:
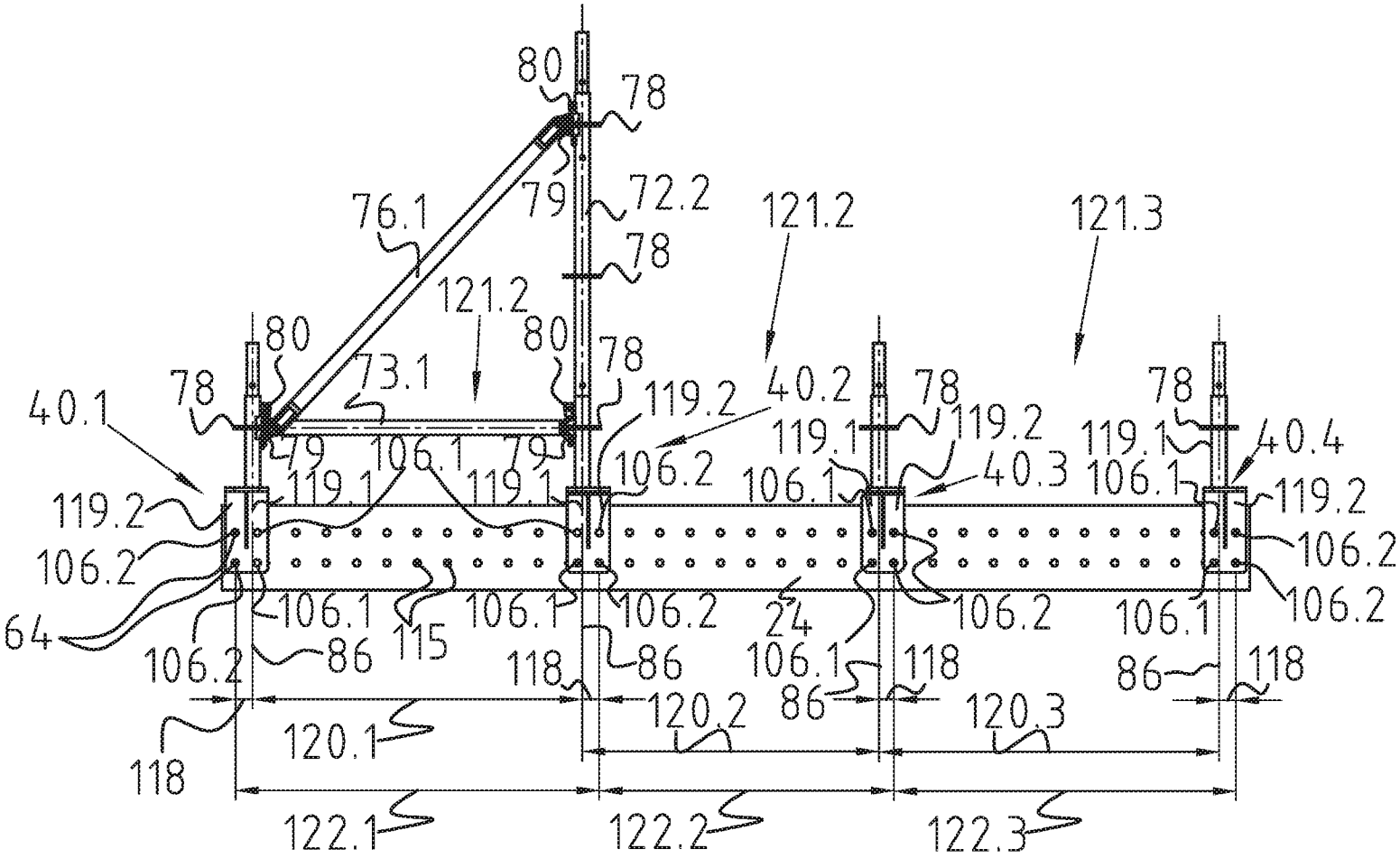
Figure 8:
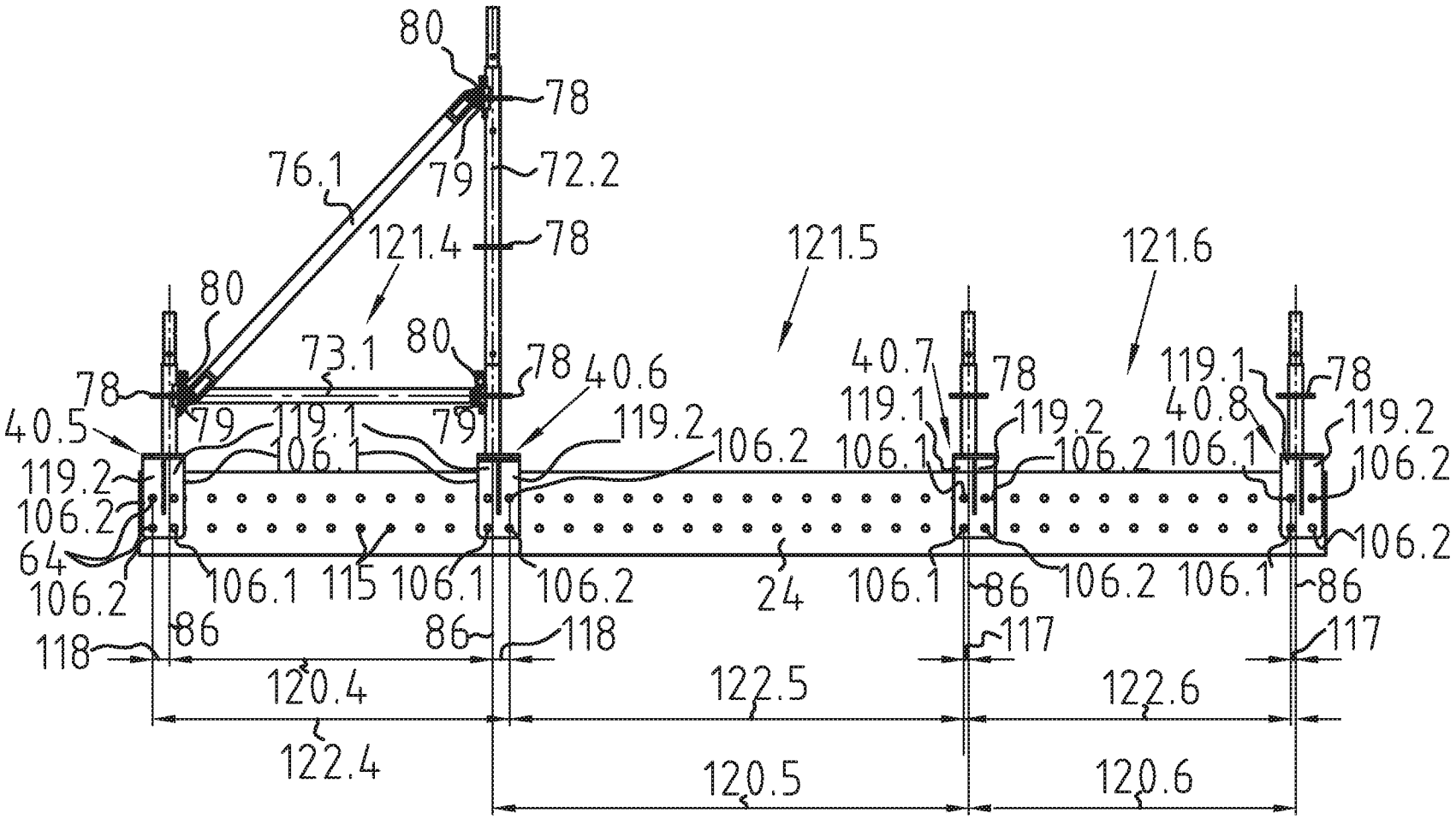
Figure 9:
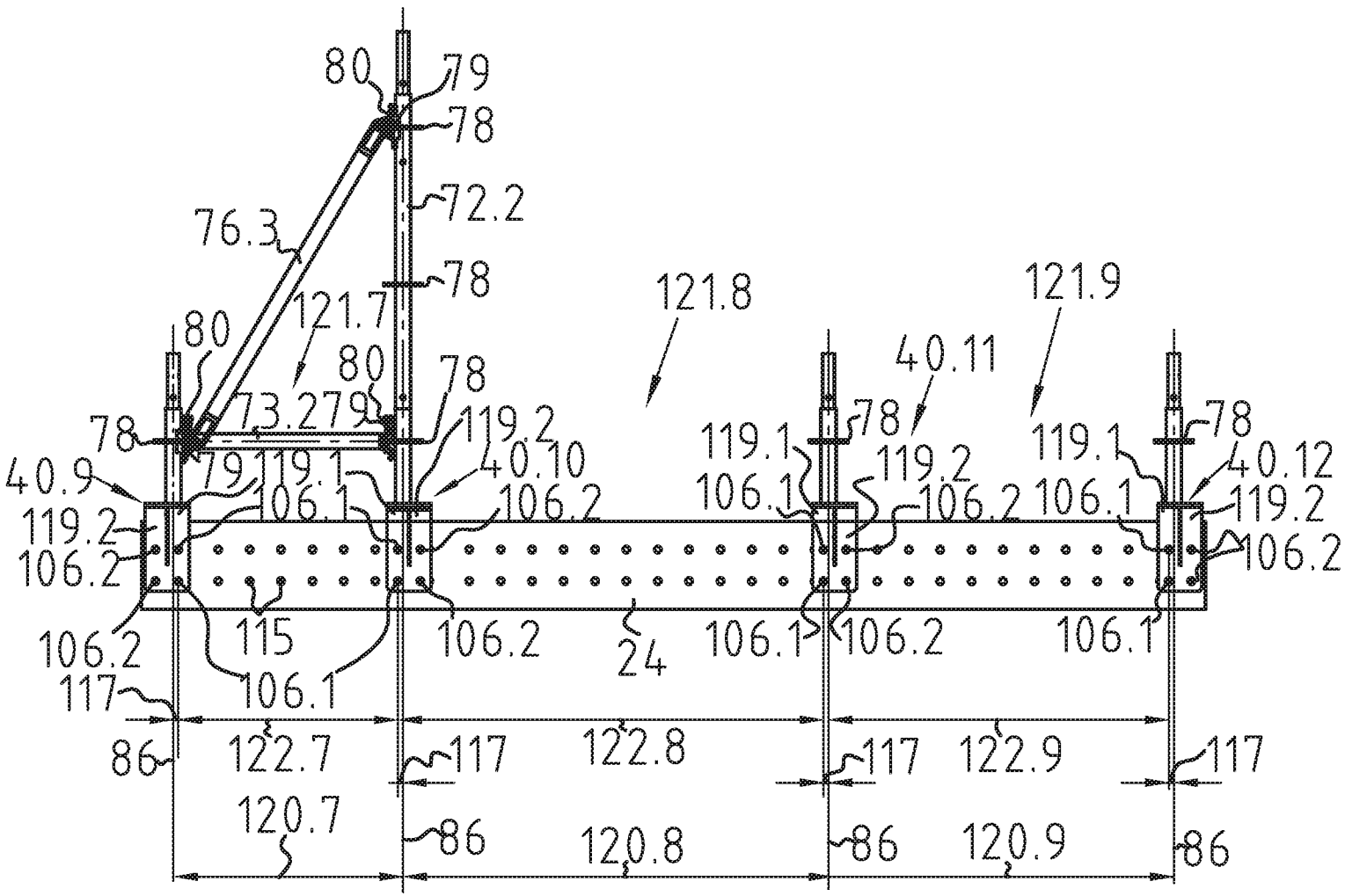

FIG. 6.1 shows a plan view of the post connection adapter according to FIG. 5;

FIG. 6.2 shows a side view of the post connection adapter according to FIG. 5;

FIG. 6.3 shows a top view of the post connection adapter according to FIG. 5;

FIG. 7 shows further embodiments of devices according to the invention with post connection adapters according to the invention;

FIG. 8 shows further embodiments of devices according to the invention with post connection adapters according to the invention; and FIG. 9 shows further embodiments of devices according to the invention with post connection adapters according to the invention.

Figure 1:
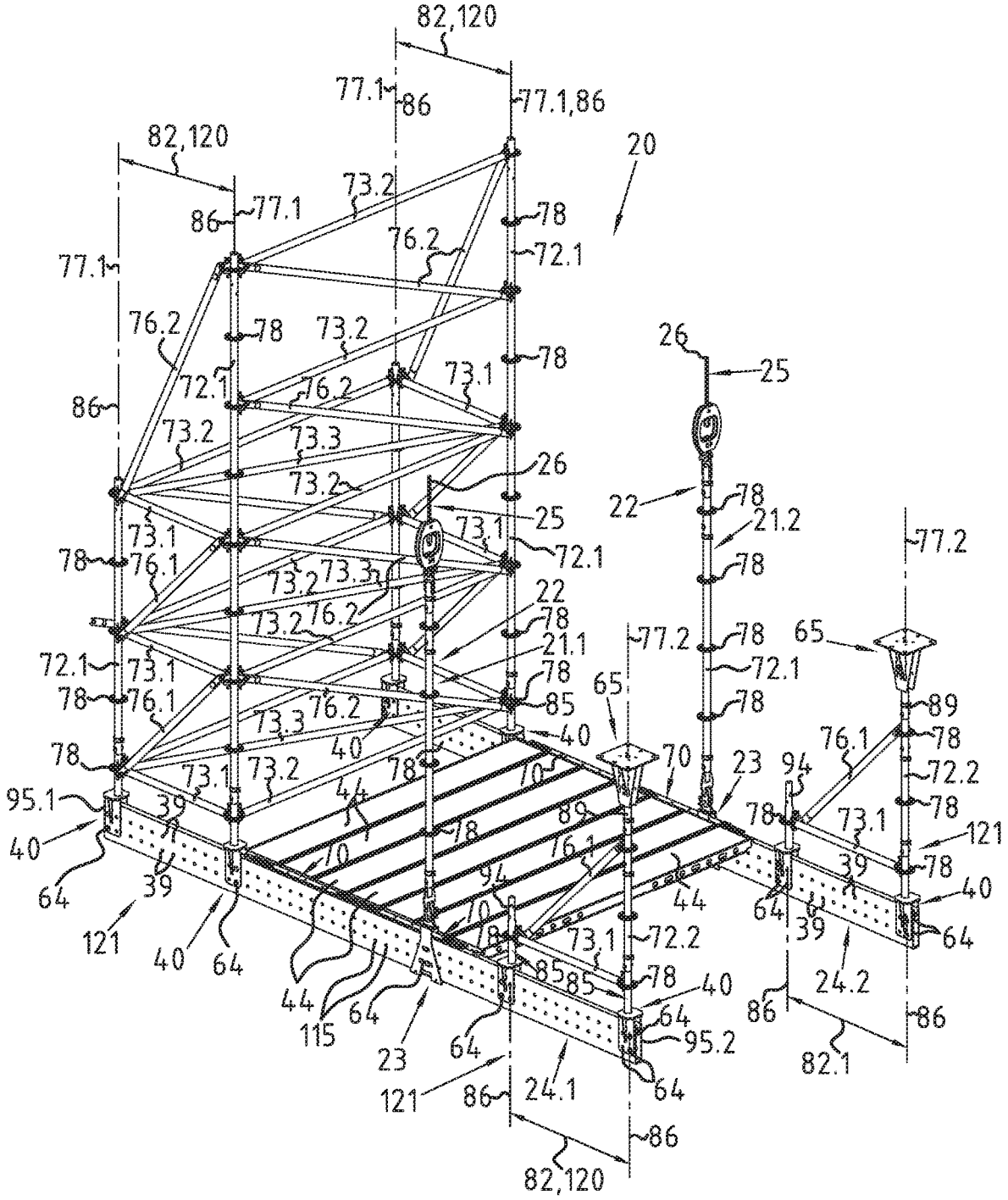
FIG. 1 shows a hanging scaffolding with two U-section beams, at each of which several post connection adapters according to the invention are fastened with formation of devices according to the invention, which are also termed post connection adapter fastening arrangements.
Figure 2:
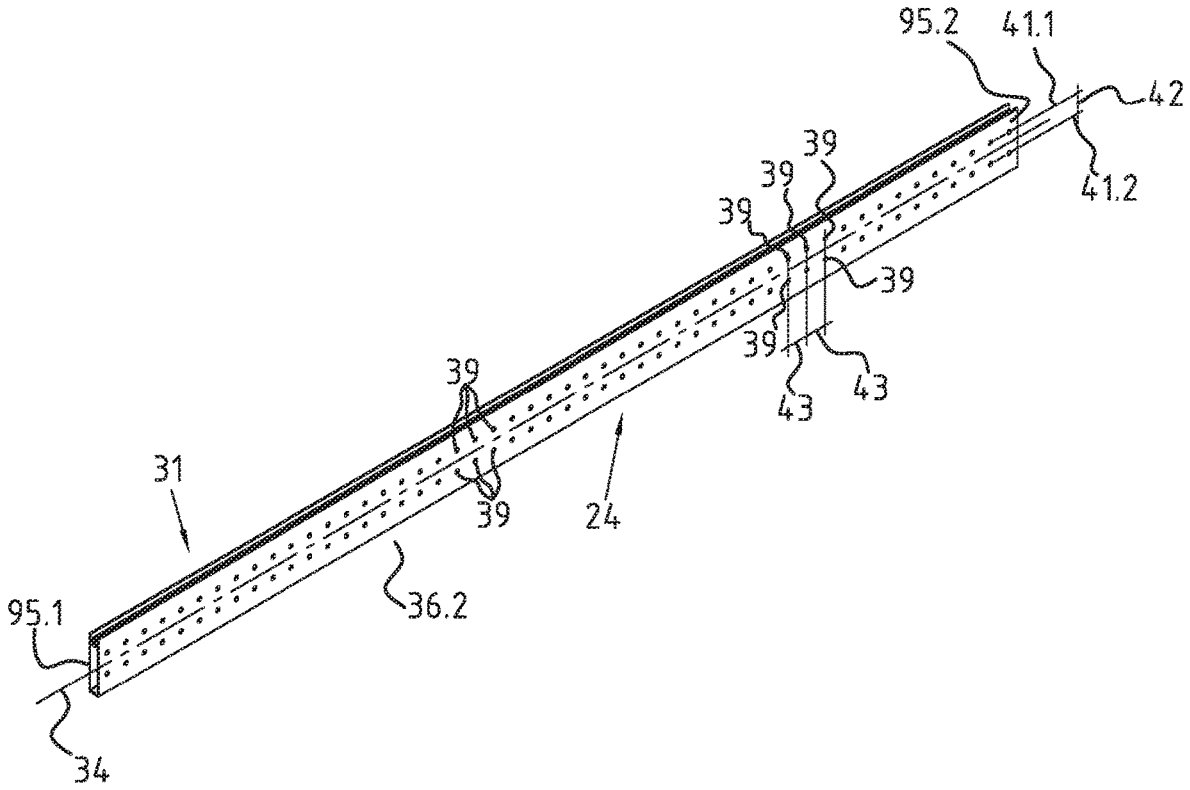
FIG. 2 shows a perspective view of a U-section beam of the two U-section beams shown in FIG. 1.
Figure 3:
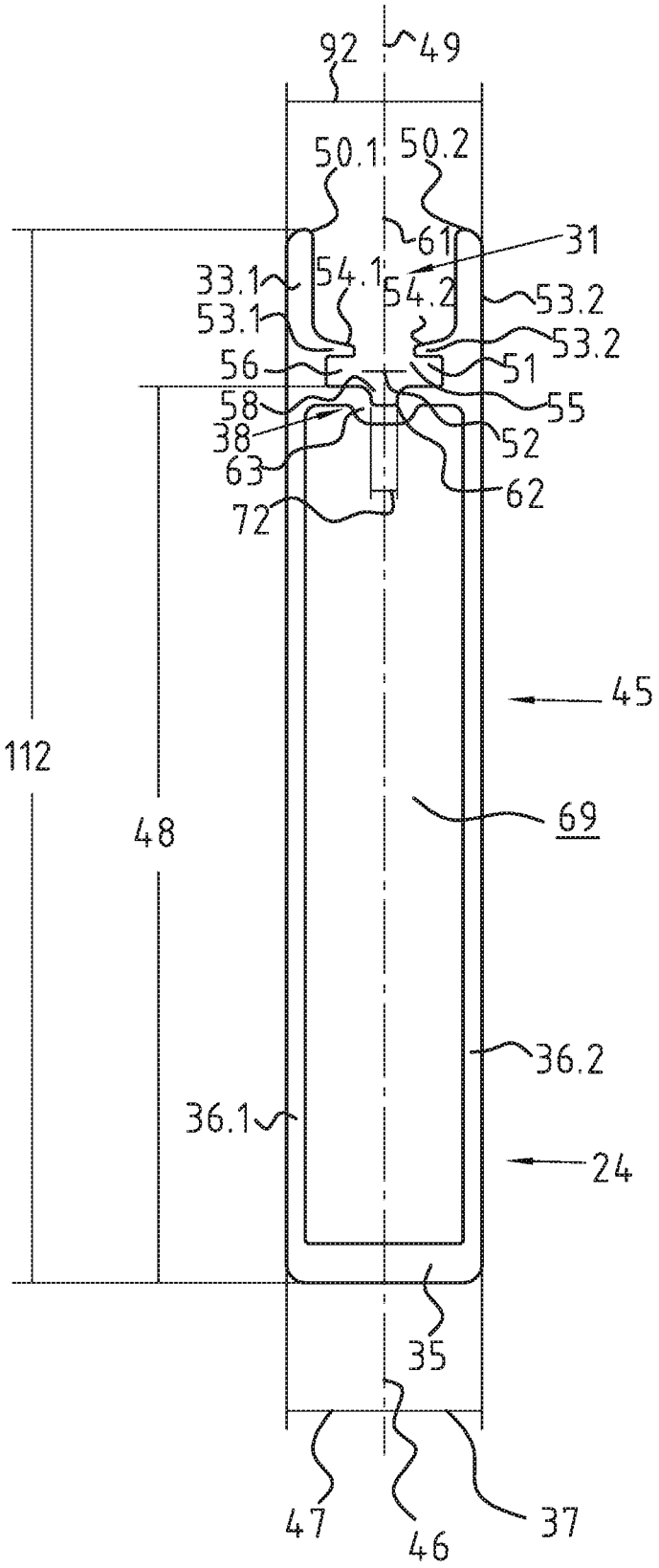
FIG. 3 shows a cross-section of the U-section beam according to FIG. 2.

FIG. 1 shows scaffolding 20, which can be hung as hanging scaffolding at constructions (not shown), for example at a bridge (not shown). For this purpose, at least two hanging devices 21.1, 21.2 are provided. Each hanging device 21.1, 21.2 comprises a support device 22, which is preferably to be arranged vertically, and a fastening device 23, which is detachably fastened thereto, for detachable fastening of a respective U-section beam 24.1, 24.2. In the illustrated embodiment the two U-section beams 24.1, 24.2 are of the same configuration. Accordingly, the reference number 24 is used uniformly in the following for U-section beams.

The fastening device 23 is a suspension shoe. Each support device 22 comprises a threaded rod 25, which is to be detachably fastened to the construction (not shown) by its upper threaded rod end 26 facing away from the suspension shoe 23. A similar support device has become known from DE 10 2016 103 224 A1 of the Applicant. Each suspension shoe 23 comprises a plurality of metal plates, which are preferably welded together, specifically a support plate 27 for deposit of the associated U-section beam 24.1, 24.2, a first trapezium-shaped side plate 28.1 for lateral support of the associated U-section beam 24 and a second trapezium-shaped side plate 28.2 for lateral support of the associated U-section beam 24, which are respectively fastened in the region of their wider trapezium side thereof to the support plate 27 and which respectively extend perpendicularly thereto and parallelly away from one another, as well as a support plate 29, which is respectively fastened to the two trapezium-shaped side plates 28.1, 28.2 in each instance in the region of the narrow trapezium side thereof. The support plate 27, the two side plates 28.1, 28.2 and the support plate 29 include a receiving space 30, which is rectangular in cross-section, for releasable reception of the associated U-section beam 24. Each U-section beam 24 is supported on the support plate 27 of the associated receiving shoe 23. Each U-section beam 24 can, for positioning, be displaced relative to the associated suspension shoe 23 as long as the latter is not yet fastened to the associated U-section beam 24 by way of fastening means.

Two U-section beams 24 which extend parallelly and at a transverse spacing from one another are shown in FIG. 1. Each U-section beam 24 is a beam of aluminium produced in an extrusion method. This can also be termed extruded aluminium U-section beam. Each U-section beam 24 extends as an elongate profile member rectilinearly in a direction parallel to the U-section beam longitudinal axis 34 thereof. In the illustrated embodiment, the two U-section beams 24 have the same U-section beam length of, for example, approximately 4 metres or approximately 5 metres or approximately 6 metres or approximately 7 metres. However, it will be understood that the U-section beams can also have a different U-section beam length. In particular, each U-section beam 24 has the same cross-section in a notional section plane perpendicular to the U-section beam longitudinal axis 34 thereof. The U-section beams 24 can be connected by means of longitudinal connectors (not shown) with one or more further corresponding U-section beams (similarly not shown) so as to achieve a desired or necessary span width.

Each U-section beam 24 comprises a plate-shaped lower wall 35 and two plate-shaped side walls 36.1, 36.2, which extend perpendicularly away therefrom in the same direction and parallelly to one another at a transverse spacing 37 corresponding with the width of the lower wall 35. The transverse spacing corresponds with the width, which for example is 52 millimetres, of the U-section beam 24. The lower wall 35 and the two side walls 36.1, 36.2 are outer walls of the U-section beam 24. The outer surfaces of the side walls 36.1, 36.2 and of the lower wall 35 are formed to be substantially planar. A transverse wall 38, which extends transversely to the two side walls 36.1, 36.2 therebetween, is formed at a spacing, which is very much larger than the width of the lower wall, from the lower wall 35.

Each side wall 36.1, 36.2 is provided with a plurality of circularly cylindrical fastening bores 39, which are also termed fastening means, for the fastening of the suspension shoe 23 and of further accessory parts, particularly the post connection adapters 40 according to the invention—which are shown in FIGS. 5, 6.1, 6.2 and 6.3 1—for detachable connection of further scaffolding components such as scaffolding posts 72.1, 72.2 and/or scaffolding rails 73.1. The beam fastening bores 39 are arranged in two rectilinearly and mutually parallelly extending longitudinal rows 41.1, 41.2, which are arranged at a height spacing 42 of, for example, 100 millimetres from one another. The beam fastening bores 39 respectively have, as considered in the direction of the respective longitudinal row 41.1, 41.2, the same bore spacing 43 of 100 millimetres from one another. Each beam fastening bore 39 has an inner diameter of preferably 21 millimetres. The same number of beam fastening bores 39 is provided in each longitudinal row 41.1, 41.2. For preference, all beam fastening bores 39 are of the same form.

Each U-section beam 24 comprises a box-shaped, cross-sectionally closed elongate cavity profile member 45 which is substantially rectangular in cross-section and the cavity 69 of which is bounded by the lower wall 35, which bounds a base of the cavity profile member 45, by the two side walls 36.1, 36.2 and by the transverse wall 38. The cavity profile member 45 of each U-section beam 24 has, as considered in a direction perpendicular to the longitudinal centre plane 46 thereof, a cavity profile member width 47 and, perpendicular to this direction as considered in a notional section plane formed perpendicularly to the longitudinal centre plane 46, a cavity profile member height 48 which is very much larger than the cavity profile member width 47.

Each U-section beam 24 has at its side opposite the lower wall 35 a U profile member 31. Each U profile member 31 is formed by the respective transverse wall 38 and by two support limbs 33.1, 33.2, which are arranged parallel to one another and parallel to the longitudinal centre plane 49 of the U profile member 31. Each side wall 36.1, 36.2 goes over at the outside in alignment into the associated support limb 33.1, 33.2, which prolongs the respective side wall 36.1, 36.2. Each support limb 33.1, 33.2 has an outer surface which is formed to be substantially planar and which is aligned with the outer surface of the associated side wall 36.1, 36.2. Each U-section beam 24 is formed symmetrically with respect to the longitudinal centre plane 46 thereof, which includes the longitudinal centre plane 49 of the respective U profile member 31. Each U-section beam has a U-section beam height 112 of, for example, 280 millimetres.

Each U-section beam 24 has a guiding and fastening groove 51, which is bounded by the respective transverse wall 38 and is open in the direction of the support edges 50.1, 50.2 of the support limbs 33.1, 33.2 as well as towards the inner sides thereof and which extends in a transverse direction transversely to the support limbs 33.1, 33.2 and in a longitudinal direction perpendicularly to the transverse direction in the direction of its longitudinal axis 52 parallelly to the U-section beam longitudinal axis 34 of the U-section beam 24. The guiding and fastening groove 51 is bounded by groove engagement-behind webs 53.1, 53.2, which are arranged at the same height along the inner sides of the two support limbs 33.1, 33.2 and which extend from the support limbs 33.1, 33.2 respectively inwardly towards one another. A longitudinal slot 55 of, for example, 16 millimetres width is formed between the mutually opposite ends 54.1, 54.2 of the groove engagement-behind webs 53.1, 53.2. The groove engagement-behind webs 53.1, 53.2 bound a locking space 56 of the guiding and fastening groove 51, in which a locking body 74.1, 74.2 can be releasably arranged at a plurality of positions along the guiding and fastening groove 51. The guiding and fastening groove 51 and the longitudinal slot 55 extend in the longitudinal direction of the U-section beam 24 parallelly to the U-section beam longitudinal axis 34 thereof continuously over the entire U-section beam length. The U profile member 31 of each U-section beam 24 is formed symmetrically with respect to its longitudinal centre plane 46 containing the U-section beam longitudinal axis 34.

The transverse wall 38 of the respective U-section beam 24 has a guide groove 58, which is open towards the locking space 56 of the guiding and fastening groove 51, for at least one support body of an anti-lift-out and support body of an anti-lift-out device 70. The guide groove 58 extends in a guide groove longitudinal direction parallel to the longitudinal axis 52 of the guiding and fastening groove 51 continuously over the entire U-section beam length of the U-section beam 24. The guide groove 58 has the same guide groove spacing from the outer surfaces of the U-section beam 24. The longitudinal centre plane 61 of the guide groove 58 coincides with the longitudinal centre plane 49 of the U profile member 31. The groove base 62 of the guide groove 58 is bounded by a transverse wall part 63, which extends in the interior of the cavity profile member 45 of the U-section beam 24, of the transverse wall 38.

At each U-section beam 24 auxiliary components such as, for example, the post connection adapters 40 according to the invention for connection and support of scaffolding posts 72.1, 72.2 and of scaffolding bars, such as transverse bars 73.1, longitudinal bars 73.2 and diagonals 76.1, 76.2, 76.3, are releasably fixed to the respective U-section beam 24 by way of bolts 64 also termed fastening means or connecting bodies. Each bolt 64 has a substantially circularly cylindrical bolt fastening section, by way of which it is respectively plugged through two mutually aligned beam fastening bores 39 of the beam fastening bores 39 provided in the side walls 36.1, 36.2 of the relevant U-section beam 24. Each bolt 64 has at one of its bolt ends a round bolt abutment head which projects laterally beyond the circularly cylindrical bolt fastening section. The other bolt end of each bolt 64 is formed as a cone frustum and narrows in a direction away from the bolt head. A passage bore extending perpendicularly to the bolt longitudinal axis is formed in the circularly cylindrical bolt fastening section closely in front of the cone frustum. In order to secure the respective bolt 64 against unintended loosening a resilient securing plug (not shown) is releasably plugged through this passage bore. The bolts 64 have an outer diameter of, for example, 20 millimetres. The bolts 64 have a bolt length of, for example, 113 millimetres.

Figure 4:
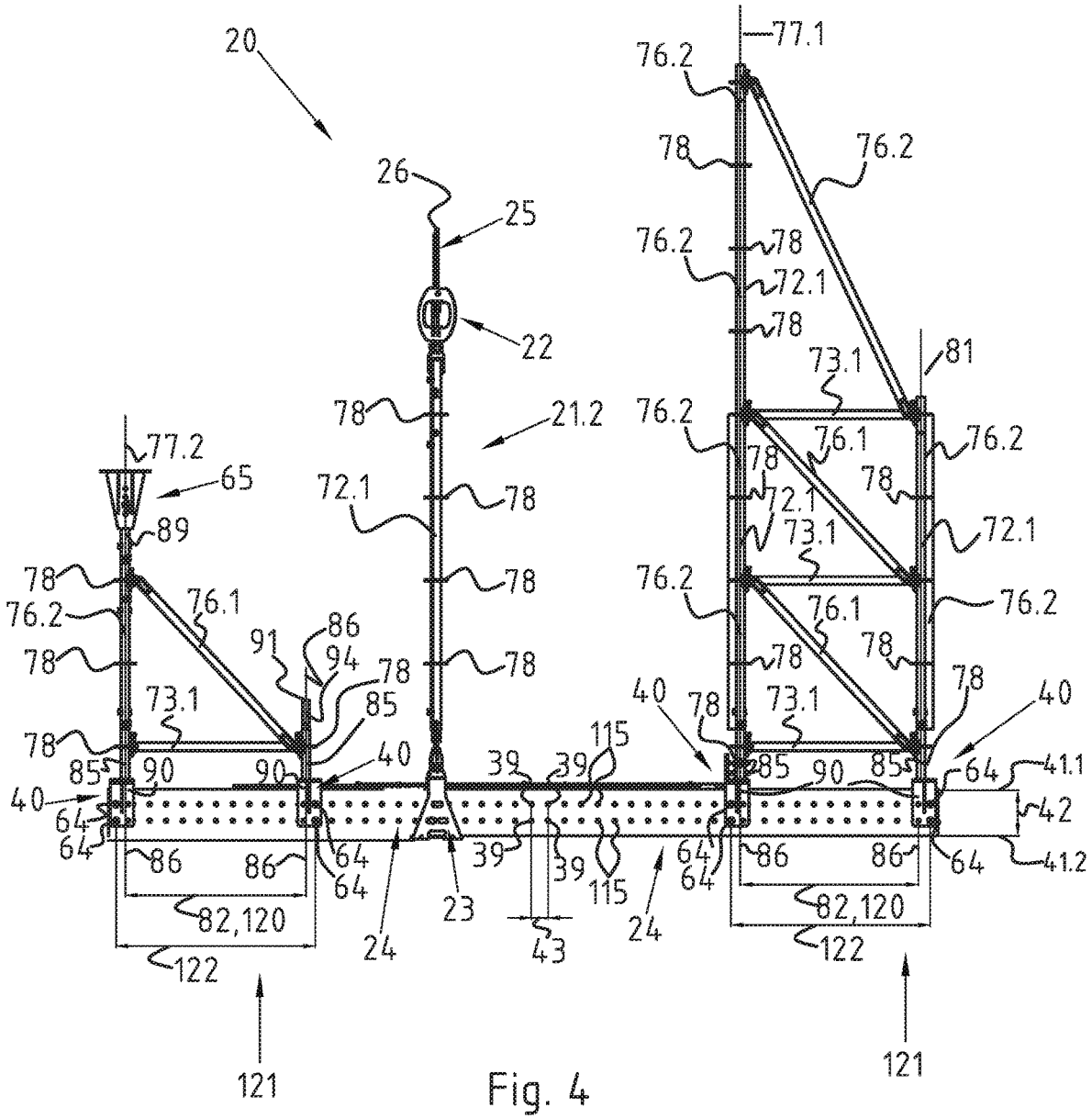
FIG. 4 shows a side view from the right of the hanging scaffolding shown in FIG. 1.

Scaffolding posts 72.1, 72.2 of modular scaffolding can be releasably fastened to the post connection adapters 40 such as shown in, for example, FIG. 1. Further scaffolding components, particularly longitudinal bars 74, transverse bars 73.1, 73.2, diagonal bars 73.3 and diagonals 76.1, 76.2, 76.3 are fastened to the scaffolding posts 72.1, 72.2 by way of the apertured discs 78 thereof, which are arranged at a pitch dimension of, here, 50 centimetres from one another. The post axes 77.1 of the parallel scaffolding posts 72.1 as shown at the outside left in FIG. 1 have a mutual system axial spacing 82 corresponding with a system axial dimension of modular scaffolding of the Applicant. This system axial dimension is here 1088 millimetres. Each scaffolding post 72.1 of the scaffolding posts 72.1 is detachably plugged onto a tube connector 94 of a post connection body 85 of a post connection adapter 40 according to the invention. In each instance, two of the post connection adapters 40 are fastened to the respective beam 40 in such a way that the post connection body axes 86 thereof have the system axial spacing 82 from one another, which is here 1088 millimetres. For that purpose the associated two post connection adapters 40 are respectively fastened to the beam 74 by way of fastening-body bores 87.2, which are termed second fastening-body fastening means, in such a way via in each instance a [ . . . ] through these fastening-body bores 87.2 and through an associated beam fastening bore 39 that the total bore spacing 122 of the respective second fastening-body bore 87.2 of the first post connection adapter 40 from the respective second fastening-body bore 87.2 of the second post connection adapter 40 is smaller by 112 millimetres than the post connection body axial spacing 120, which corresponds with the system axial spacing 82, of the post connection body axes 86 of the first and second post connection adapter 40 (see FIG. 4). This is achieved in that the bolts 64 are plugged through beam fastening bores 39 of the beam 24, which have an overall bore spacing of 1200 millimetres from one another. In addition, the two bolts 64 concerned are plugged through two beam fastening bores 39 which as considered in the direction of the respective longitudinal row 41.1, 41.2 are arranged to be spaced from one another by twelve beam fastening bores. The two post connection adapters 40 together with the beam 24 form a post connection adapter fastening arrangement 121.

With the object of flexibility for the respective local conditions, particularly with respect to height relationships and inclinations, a beam connecting device 65 can be detachably fastened to each U-section beam 24. Each beam connection device 65 is connected, in accordance with a first alternative which is shown in FIG. 1, with use of a respective connecting tube to a respective scaffolding post 72.2 fastened by means of at least one post connection adapter 40 according to the invention to the U-section beam 24. A respective further post connection adapter 40 according to the invention is fastened to each beam 84 at the post connection body axial spacing 120, which corresponds with the system axial spacing 82, of here similarly 1088 millimetres from the post axis 77.2 of this scaffolding post 72.2. No post is plugged to this tube connector 94. However, a transverse bar 73.1 is detachably fastened by its connecting heads 79 to the apertured disc 78 of the post connection body 85 of this connection adapter 40 and to the apertured disc 78 of the post connection body 85, which supports the scaffolding post 72.2, of the associated other post connection adapter 40. The parallel post connection body axes 86 of these two post connection adapters 40 similarly have the connection body axial spacing 120 corresponding with the system axial spacing 82 of 1088 millimetres from one another. These two post connection adapters 40 together with the beam 24 also form a post connection adapter fastening arrangement 121. According to a second alternative (not shown), the beam connecting device can be selectably directly detachably fastened to the U-section beam. Through selection of the beam fastening bores 39 for the bolting together, the bearing requirements of the U-section beam 24 can be realised as flexible or as stiff in bending and the height position of the U-section beam 24 varied, although to a smaller extent than in the case of the said first alternative. Beam connection devices 65 for flexible direct or indirect support and/or fastening of the respective U-section beam 24 on or to the construction (not shown) can thus be selectably fastened, preferably detachably, to the U-section beams 24.

Scaffolding floors 44, which are adjacent to one another at the longitudinal side and extend perpendicularly to the U-section beams 24, are suspended by their suspension hooks 32 in the outwardly and upwardly open U profile members 31 of the U-section beams 24 extending at a transverse spacing parallelly to one another. The suspension hooks 32, which in the embodiment are respectively formed as so-called U-claws, are fastened to the narrow ends of the scaffolding floors 44, preferably by welding. By contrast to so-called O-claws, which are designed and intended for suspension in O profile members such as scaffolding tubes having a round cross-section, U-claws 32 are designed and intended for suspension in U profile members, particularly in the U profile members 31. In the illustrated embodiment, two suspension hooks 32 are arranged at a transverse spacing from one another at each narrow end of each scaffolding floor 44. Each suspension hook 32 as considered in a direction away from the respective walk and work surface of the associated scaffolding floor 44, thus in installation setting, is open downwardly as well as towards its two sides.

It will be obvious that it is also possible for three or more parallel U-section beams 24 to be provided, which can be arranged at a transverse spacing from one another. It is then possible to suspend in the U profile member 31 of at least one U-section beam 24—which as considered in transverse direction is arranged to be inwardly disposed between two other parallel U-section beams, thus as considered in transverse direction—further scaffolding floors by their suspension hooks 32 in such a way that the suspension hooks 32 of scaffolding floors 44, which extend away from one another transversely or perpendicularly from the inwardly disposed U-section beam 24, rest on two support limbs 33.1, 33.2 of the U profile member 31 of this inwardly disposed U-section beam 24.

At least one suspension hook 32 of the suspension hooks 32 or several or all suspension hooks 32 of the suspension hooks 32 is or are secured by means of several anti-lift-out devices 70 against lifting out of the respective U profile member 31 of the respective U-section beam 24, thus against being unhooked in upward direction. The anti-lift-out devices 70 are detachably fastened to the U-section beam 24.

The configuration of the post connection adaptor 40, which in each instance is of the same construction, is described in more detail in the following with reference to FIGS. 5, 6.1, 6.2 and 6.3 by way of the example of a post connection adaptor 40 according to the invention:

Each post connection adapter 40 comprises a fastening body 90 and a post connection body 85 fastened thereto.

The post connection body 85 extends rectilinearly along its post connection body axis 86. The post connection body 85 has a post connection body end 91 extending away from the fastening body 90. The post connection body 85 is formed as a tube 100, the tube axis 102 of which is in alignment with the post connection body axis 86. An apertured disc 78, which is known per se, is fastened to the tube 100 by welding and engages completely around the outer circumference of the tube 100. Other scaffolding components, such as longitudinal bars, transverse bars or diagonals can be detachably locked to the apertured disc 78 by way of connecting heads 79 in each instance by means of a wedge 80. For that purpose, the apertured disc 78 in turn has in known manner eight passage holes 92.1, 92.2 which are arranged to be mutually offset at the same circumferential angles of 45 degrees. The apertured disc 78 has an apertured-disc spacing 93 from the fastening body 90. The post connection body 85 comprises a tube connector 94 for the plugging-on of a post, the tube connector axis 95 of which is aligned with the post connection body axis 86 and extends in the direction of the tube connector axis 95 up to the post connection body end 91. The tube connector 94 has an outer diameter which is slightly smaller than an inner diameter of the scaffolding posts 72.1, 72.2 able to be plugged thereon.

The fastening body 90 comprises a U profile member 96 which is open in direction away from the post connection body end 91 as well as towards sides facing away from one another. The U profile member 96 has two parallel U profile member limbs 97.1, 97.2 which extend away from a base body 98 of the U profile member 96 in the same directions from the post connection body end 91 in the direction of its free U profile member limb ends 99.1, 99.2. The two U profile member limbs 97.1, 97.2 are of the same form. Each U profile member limb 97.1, 97.2 is formed as a rectangular plate. Each plate has a plate width 101 and a plate height greater than the plate width 101. In the illustrated embodiment the plate width 101 is preferably 140 millimetres. The plates 97.1, 97.2 of the two U profile member limbs respectively extend in a plate plane parallel to one another. Provided at the outwardly facing outer surfaces of each U profile member limb 97.1, 97.2 is a respective stiffening body 105.1, 105.2 which extends out from a lower surface of the base body 98 parallel to the post connection body axis 86 in the direction of the respective U profile member limb end 99.1, 99.2. Each stiffening body 105.1, 105.2 is rigidly connected, preferably by welding, not only with the U profile member limb 97.1, 97.2, but also with the base body 88.

The U profile member 96 is formed symmetrically with respect to a centre plane 103 of symmetry containing the post connection body axis 86. The two U profile member limbs 97.1, 97.2 as considered in a direction perpendicular to the post connection body axis 86 have a mutual limb spacing 104. The limb spacing 104 is slightly larger than the transverse spacing 37, which corresponds with the width of the beam, of the two parallel side walls 36.1, 36.2 of the beam 24. If, as in the embodiment, the two parallel side walls 36.1, 36.2 of the beam 24 have a transverse spacing 37 of 52 millimetres from one another then it has proved advantageous if the limb spacing 104 of the two U profile member limbs 97.1, 97.2 of the U profile member 96 of the fastening body 90 of the post connection adapter 40 is 56 millimetres Each U profile member limb 97.1, 97.2 of the fastening body 90 has four fastening-body fastening means 87.1, 87.2 each in the form of a circularly cylindrical fastening bore. The bore centre points 106.1, 106.2 of the fastening-body bores 87.1, 87.2 form fastening-body fastening positions.

The respective bore centre points 106.1 of two first fastening-body bores 87.1 of the four fastening-body bores 87.1, 87.2 are arranged on a notional first straight line 107.1 and also on a notional first fastening-body fastening position plane 88.1 containing the notional first straight line 107.1, which extend respectively parallel to the post connection body 86 and parallel to the post connection body axial plane 110. The respective bore centre points 106.2 of two second fastening-body bores 87.2, which are the two other fastening-body bores of the four fastening-body bores 87.1, 87.2, are arranged on a notional second straight line 107.2 and also on a notional second fastening-body fastening position plane 88.2 containing the notional second straight line 107.2, which in each instance extend parallel to the post connection body axis 86 and parallel to the post connection body axial plane 110. The notional first straight line 107.1 and the notional second straight line 107.2 have a mutual spacing 108 of 72 millimetres. The notional first fastening-body fastening position plane 88.1 and the notional second fastening-body fastening position plane 88.2 similarly have a mutual spacing 108 of 72 millimetres. The notional first fastening-body fastening position plane 88.1 and the notional second fastening-body fastening position plane 88.2 similarly have a mutual spacing 108 of 72 millimetres. In other words, the or the respective first fastening-body fastening position 106.1 and the or the respective second fastening-body fastening position 106.2 have a mutual position spacing 108 of 72 millimetres. A notional centre plane 109, which extends in the middle between the notional first straight line 107.1 and the notional second straight line 107.2 and parallel to the first and second straight lines 107.1, 107.2, has a spacing 112 of 20 millimetres from a post connection body axial plane 110, which extends parallel thereto and contains the post connection body axis 86, as considered in a direction perpendicular to the centre plane 109 and perpendicular to the post connection body axis 86. The notional first fastening-body fastening position plane 88.1 has a first spacing 114.1 of 36 millimetres from the notional centre plane 109. The notional second fastening-body fastening position plane 88.2 has a second spacing 114.1 similarly of 36 millimetres from the notional centre plane 109. The notional centre plane 109 extends in each instance in the centre between the first fastening-body fastening position 106.1 and the second fastening-body fastening position 106.2 and respectively contains a notional centre point 111. The notional centre plane 109 extends parallel to the post connection body axial plane 110 containing the post connection body axis 86. The notional centre plane 109 as considered in a direction perpendicular to the centre plane 109 and perpendicular to the post connection body axis 86 is arranged offset at the spacing 112 of 20 millimetres.

The bore centre point 106.1 of the first fastening bore 87.1, which is arranged further away from the base body 98 of the U profile member 96, of the two first fastening bores 87.1, 87.2 and the bore centre point 106.2 of the second fastening bore 87.2, which is arranged further away from the base body 98 of the U profile member 96, of the two second fastening bores 87.1, 87.2 are arranged on a notional third straight line 113.1 perpendicularly to the post connection body 86 or perpendicularly to the post connection body axial plane 110. The bore centre point 106.1 of the first fastening bore 87.1, which is closer to the base body 98 of the U profile member 96, of the two first fastening bores 87.1, 87.2 and the bore centre point 106.2 of the second fastening bore 87.2, which is arranged closer to the base body 98 of the U profile member 96 of the two second fastening bores 87.2, are arranged on a notional fourth straight line 113.2 perpendicularly to the post connection body axis 86 or perpendicularly to the post connection body axial plane 110. The notional fourth straight line 113.2 extends parallel to the notional third straight line 113.1. The notional third straight line 113.1 and the notional fourth straight line 113.2 have a mutual fastening-body fastening means spacing 142 of preferably 42 millimetres. This fastening-body fastening means spacing 142 is the same size as the spacing 42 of the two notional longitudinal rows 41.1 and 41.2, at which the bore centre points, which form beam fastening positions 115, of the beam fastening bores 39 of the beam 24 are arranged.

Since the two U profile member limbs 97.1, 97.2 of the U profile member 96 are of the same form, the fastening-body bores 87.1, 87.2 respectively formed therein are also of the same configuration and the bore centre points 106.1, 106.2 thereof are also correspondingly formed. As a result, the bore axes, which extend through the bore centre points 106.1, 106.2 of the corresponding fastening-body bores 87.1, 87.2 of the two U profile member limbs 97.1, 97.2, of the fastening-body bores 87.1, 87.2 of the fastening body 90 extend parallel to one another.

In the case of each U profile member limb 97.1, 97.2 of the U profile member 96 the bore centre points 106.1 of the respective two first fastening-body bores 87.1 as considered in a first spacing direction 116.1 perpendicular to the centre plane 109, which contains the post connection body axis 86, of the U profile member 96 and also perpendicular to the post connection body axial plane 110 are arranged at a first spacing 117 of 16 millimetres from the post connecting body axial plane.

By contrast thereto, in the case of each U profile member limb 97.1, 97.2 of the U profile member 96 the bore centre points 106.2 of the respective two second fastening-body bores 87.2 as considered in a second spacing direction 116.2, which is opposite to the first spacing direction 116.1, perpendicular to the said post connection body axial plane 110 are arranged at a second spacing 118 of 56 millimetres from the post connection body axial plane 110.

It follows therefrom that depending on which fastening-body bore pairs, thus either the respective two first fastening-body bores 87.1 of the respective U profile member limb 97.1, 97.2 of the U profile member 96 or the respective two second fastening-body bores 87.2 of the respective U profile member limb 97.1, 97.2 of the U profile member 96, are used to fasten the post connection adapter 40 by means of the bolts 64 to the desired beam fastening bores 39 a corresponding offset of the post connection body axis 86 with respect to the selected fastening-body bores 87.1 or 87.2 by either 16 millimetres or 56 millimetres is achieved.

In the case of each U profile member limb 97.1, 97.2 of the U profile member 96 the respective first fastening-body bores 87.1 are associated with a first narrow fastening-body part 119.1 of the fastening body 90, which as considered in the first spacing direction 116.1 perpendicular to the post connection body axial plane 110 projects beyond the post connection body axial plane 110. Moreover, in the case of each U profile member limb 97.1, 97.2 of the U profile member 96 the respective second fastening-body bores 87.2 are associated with a second wide fastening-body part 119.2 of the fastening body 90, which as considered in the first spacing direction 116.1 perpendicular to the post connection body axial plane 110 protrudes beyond the post connection body axial plane 110.

According to the invention, in each instance two identical post connection adapters 40 can—for detachable fastening of posts for scaffolding of a scaffolding system, preferably a modular scaffolding system, particularly of the Applicant, the parallel post axes of which can or are to be arranged relative to one another at system axial spacings of the scaffolding system, or, expressed more generally, for formation of a post connection adapter arrangement in which the two parallel post connection body axes 86 of the two post connection bodies 85 of these two post connection adapters 40 can or are to be arranged relative to one another at system axial spacings of the scaffolding system—now be selectably fastened at a respective different beam fastening position 115 of the beam fastening positons 115 of the beam 24 as follows:

a) by way of the first or the plurality of first fastening-body fastening means 87.1 of the first post connection adapter 40 and by way of the first or the plurality of first fastening-body fastening means 87.1 of the second post connection adapter 40 in such a way that the post connection body axis 86 of the first post connection adapter 40 and the post connection body axis 86, which extends parallel thereto, of the second post connection adapter 40 have a mutual post connection body axial spacing which is larger by 32 millimetres or smaller by 32 millimetres than a fastening-position spacing of the first fastening-body fastening position 106.1 of the first fastening-body fastening means 87.1 of the first post connection adapter 40 from the first fastening-body fastening position 106.1 of the first fastening-body fastening means 87.1 of the second post connection adapter 40, or;

b) by way of the second fastening-body fastening means 87.2 of the first post connection adapter 40 and by way of the second fastening-body fastening means 87.2 of the second post connection adapter 40 in such a way that the post connection body axis 86 of the first post connection adapter 40 and the post connection body axis 86, which extends parallel thereto, of the second post connection adapter 40 have a mutual post connection body axial spacing which is larger by 112 millimetres or smaller by 112 millimetres than a fastening-position spacing of the second fastening-body fastening position 106.2 of the second fastening-body fastening means 87.2 of the first post connection adapter 40 from the second fastening-body fastening position 106.2 of the second fastening-body fastening means 87.2 of the second post connection adapter 40, or;

c) by way of the first fastening-body fastening means 87.1 of the first post connection adapter 40 and by way of the second fastening-body fastening means 87.2 of the second post connection adapter 40 in such a way that the post connection body axis 86 of the first post connection adapter 40 and the post connection body axis 86, which extends parallel thereto, of the second post connection adapter 40 have a mutual post connection body axial spacing which is larger by 72 millimetres or smaller by 72 millimetres than a fastening-position spacing of the first fastening-body fastening position 106.1 of the first fastening-body fastening means 87.1 of the first post connection adapter 40 from the second fastening-body fastening position 106.2 of the second fastening-body fastening means 87.2 of the second post connection adapter 46, or by way of the first fastening-body fastening means 87.1 of the second post connection adapter 40 and by way of the second fastening-body fastening means 87.2 of the first post connection adapter 40 in such a way that the post connection body axis 86 of the first post connection adapter 40 and the post connection body axis 86, which extends parallel thereto, of the second post connection adapter 40 have a mutual post connection body axial spacing which is larger by 72 millimetres or smaller by 72 millimetres than a fastening-position spacing of the second fastening-body fastening position 106.2 of the second fastening-body fastening means 87.2 of the first post connection adapter 40 from the first fastening-body fastening position 106.1 of the first fastening-body fastening means 87.1 of the second post connection adapter 40, or;

d) by way of the first fastening-body fastening means 87.1 of the first post connection adapter 40 and by way of the second fastening-body fastening means 87.2 of the second post connection adapter 40 in such a way that the post connection body axis 86 of the first post connection adapter 40 and the post connection body axis 86, which extends parallel thereto, of the second post connection adapter 40 have a mutual post connection body axial spacing which is larger by 40 millimetres or smaller by 40 millimetres than a fastening-position spacing of the first fastening-body fastening position 106.1 of the first fastening-body fastening means 87.1 of the first post connection adapter 40 from the second fastening-body fastening position 106.2 of the second fastening-body fastening means 87.2 of the second post connection adapter, or by way of the first fastening-body fastening means 87.1 of the second post connection adapter 40 and by way of the second fastening-body fastening means 87.2 of the first post connection adapter 40 in such a way that the post connection body axis 86 of the first post connection adapter 40 and the post connection body axis 86, which extends parallel thereto, of the second post connection adapter 40 have a mutual post connection body axial spacing which is larger by 40 millimetres or smaller by 40 millimetres than a fastening-position spacing of the second fastening-body fastening position 106.2 of the second fastening-body fastening means 87.2 of the first post connection adapter 40 from the first fastening-body fastening position 106.1 of the first fastening-body fastening means 87.1 of the second post connection adapter 40.

These combinations of post connection adapter fastening arrangements of, in each instance, two identical post connection adapters 40, 40 at the beam 24 can, particularly in practice be realised by an assembler (not shown) quite simply depending on the respectively desired or required post connection body axial spacing of the two post connection body axes 86, 86 thereof in that the two post connection adapters 40, 40 are fastened to the beam 24 in such a way that the wide fastening-body parts 119.1, 119.2 of the fastening bodies 90, 90 of the two post connection adapters 40, 40 in the mounted state extend either in the same direction or in opposite directions away from one another or in opposite directions towards one another, and that two post connection adapters 40, 40 are fastened to the beam 24 in such a way that a first post connection adapter 40 of these two post connection adapters 40, 40 is fastened to the beam 24 by way of its first fastening-body fastening means 87.1 or by way of its second fastening-body fastening means 87.2 via a first beam fastening means 39 and that a second post connection adapter 40 of these two post connection adapters 40, 40 is fastened to the beam 24 by way of its first fastening-body fastening means 87.1 or by way of its second fastening-body fastening means 87.2 via another second beam fastening means 39 at the desired or required spacing from the first beam fastening means 39.

Embodiments of some post connection adapter fastening arrangements 121, 121.1, 121.2, 121.3, 121.4, 121.5, 121.6, 121.7, 121.8, 121.9 of, in each instance, two identical post connection adapters 40; 40.1, 40.2, 40.3, 40.4, 40.5, 40.6, 40.7, 40.8, 40.9 at the beam 24 are shown in FIGS. 7 to 9.

In the case of the first post connection adapter fastening arrangement 121.1 shown on the outside left in FIG. 7 a first post connection adapter 40.1 and an identical second post connection adapter 40.2 are fastened to a beam 24 in such a way that the wide fastening-body parts 119.1, 119.2 thereof face in opposite directions away from one another and that the two post connection adapters 40.1, 40.2 are each fastened by way of their respective second fastening-body bores 87.2 by means of a respective bolt 64 at associated beam fastening bores 39, which as considered in the direction of the respective longitudinal rows 41.1, 41.2 thereof are arranged offset relative to one another by twelve beam fastening bores 39, which thus have a first overall bore spacing 122.1 of 12×100 millimetres=1200 millimetres from one another. Consequently, the two post connection body axes 86 of the first post connection adapter 40.1 and the second post connection adapter 40.1 have a mutual first post connection body axial spacing 120.1 of 1088 millimetres.

The beam shown in FIG. 7 differs from each of the beams 24 shown in FIG. 1 exclusively by a shorter beam length and by a corresponding small number of beam fastening bores 39. Accordingly, for the sake of simplicity this beam is similarly provided with the reference numeral 24.

A scaffolding bar 73.1 is detachably fixed by way of its connecting heads 79 to the apertured disc 78 of the first post connection adapter 40.1 and to the apertured disc 78 of the second post connection adapter 40.2 by means of a respective wedge 80. The length of this scaffolding bar 73.1 is designed to be adapted to a first post axial spacing of 1088 millimetres. A short scaffolding post 72.2, which is equipped with two apertured discs 78, is plugged onto the tube connector 94 of the post connection body 85 of the second post connection adapter 40.2. These two apertured discs 78 have a mutual pitch spacing of 50 centimetres. The lower apertured disc 78 of the two apertured discs 78, 78 similarly has a pitch spacing of 50 centimetres from the apertured disc 78 of the second post connection adapter 40.2. A diagonal 76.1 is detachably fixed, by way of the connecting heads thereof by means of a respective wedge 80, to the apertured disc 78 of the first post connection adapter 40.1 and to the apertured disc 78 of the short scaffolding post 72.2.

In addition, two further post connection adapters are fastened to the same beam 24, namely a third post connection adapter 40.3 and a fourth post connection adapter 40.4.

The third post connection adapter 40.3 together with the second post connection adapter 40.2 forms a second post connection adapter fastening arrangement 121.2. A third post connection adapter 40.3 is fastened to the beam 24 in such a way that the wide fastening-body part 119.2 thereof faces in the same direction as the wide fastening-body part 119.2 of the second post connection adapter 40.2 and that the third post connection adapter 40.3 is fastened by way of its respective second fastening-body bores 87.2 by means of bolts 64 at associated beam fastening bores 39, which are arranged to be offset by ten beam fastening bores 39 relative to those beam fastening bores 39 at which the second fastening-body bores 87.2 of the second post connection adapter 40.2 are fastened by means of bolts 64. These beam fastening bores 39 thus have a second overall bore spacing 122.2 of 10×100 millimetres=1000 millimetres from one another. As a result, the two post connection body axes 86 of the second post connection adapter 40.2 and the third post connection adapter 40.3 have a mutual second post connection body axial spacing 120.2 similarly of 1000 millimetres.

A fourth post connection adapter 40.4 together with the third post connection adapter 40.3 forms a third post connection adapter fastening arrangement 121.3. The fourth post connection adapter 40.4 is in turn fastened to the beam 24 in such a way that the wide fastening-body part 119.2 thereof faces in the same direction as the wide fastening-body part 119.2 of the third post connection adapter 40.3 and that also the fourth post connection adapter 40.4 is fastened by way of its respective second fastening-body bores 87.2 by means of bolts 64 at associated beam fastening bores 39 which are arranged to be offset by ten beam fastening bores 39 relative to those beam fastening bores 39 at which the second fastening-body bores 87.2 of the third post connection adapter 40.3 are fastened by means of bolts 64. These beam fastening bores 39 thus similarly have a third overall bore spacing 122.3 of 10×100 millimetres=1000 millimetres from one another. As a result, the two post connection body axes 86 of the third post connection adapter 40.3 and the fourth post connection adapter 40.4 have a mutual third post connection body axial spacing 120.4 similarly of 1000 millimetres.

Further post connection adapter fastening arrangements 121.4, 121.5, 121.6 of post connection adapters 40.5, 40.6, 40.7 fastened to a further beam 24 are shown in FIG. 8. These further beams differ from the beam shown in FIG. 7 only by a larger beam length and by a correspondingly larger number of beam fastening bores 39. Accordingly, for the sake of simplicity this beam is similarly provided with the reference numeral 24.

The fourth post connection adapter fastening arrangement 121.4 shown on the outside left in FIG. 8 has the same configuration and the same arrangement and mounting as the first post connection adapter fastening arrangement 121.1 shown on the outside left in FIG. 7. For the sake of better capability of distinction, in the case of the fourth post connection adapter fastening arrangement 121.4 the two post connection adapters 40 are termed fifth post connection adapter 40.5 and sixth post connection adapter 40.6. A fourth overall bore spacing 122.5 is realised thereat and has the same size as the first overall bore spacing 122.1.

In addition, two further post connection adapters are fastened to the same beam 24, namely a seventh post connection adapter 40.7 and an eighth post connection adapter 40.8.

The seventh post connection adapter 40.7 together with the sixth post connection adapter 40.6 forms a fifth post connection adapter fastening arrangement 121.5. The seventh post connection adapter 40.7 is in turn fastened to the beam 24 in such a way that the wide fastening-body part 119.2 thereof faces in the same direction as the wide fastening-body part 119.2 of the sixth post connection adapter 40.6 and that the seventh post connection adapter 40.7 is fastened by way of its respective first fastening-body bores 87.1 by means of bolts 64 at associated beam fastening bores 39 which are arranged to be offset by fifteen beam fastening bores 39 relative to those beam fastening bores 39 at which the second fastening-body bores 87.2 of the sixth post connection adapter 40.6 are fastened by means of bolts 64. These beam fastening bores 39 thus have a fifth overall bore spacing 122.3 of 15×100 millimetres=1500 millimetres from one another. As a result, the two post connection body axes 86 of the sixth post connection adapter 40.6 and the seventh post connection adapter 40.7 have a mutual fifth post connection body axial spacing 120.5 of 1572 millimetres.

A eighth post connection adapter 40.8 together with the seventh post connection adapter 40.7 forms a sixth post connection adapter fastening arrangement 121.6. The eighth post connection adapter 40.8 is in turn fastened to the beam 24 in such a way that the wide fastening-body part 119.2 thereof faces in the same direction as the wide fastening-body part 119.2 of the seventh post connection adapter 40.7 and that also the eighth post connection adapter 40.8 is fastened by way of its respective first fastening-body bores 87.1 by means of bolts 64 at associated beam fastening bores 39 which are arranged to be offset by ten beam fastening bores 39 relative to those beam fastening bores 39 at which the first fastening-body bores 87.1 of the seventh post connection adapter 40.7 are fastened by means of bolts 64. These beam fastening bores 39 thus similarly have a sixth overall bore spacing 122.6 of 10×100 millimetres=1000 millimetres from one another. As a result, the two post connection body axes 86 of the seventh post connection adapter 40.7 and the eight post connection adapter 40.8 have a mutual sixth post connection body axial spacing 120.6 similarly of 1000 millimetres.

Further post connection adapter fastening arrangements 121.7, 121.8, 128.9 of post connection adapters 40.9, 40.10, 40.11, 40.12 fastened to a further beam are shown in FIG. 9. This further beam differs from the beam 24 shown in FIG. 8 only by a smaller beam length and by a correspondingly smaller number of beam fastening bores 39. Accordingly, for the sake of simplicity this beam 24 is similarly provided with the reference numeral 24.

In the case of the seventh post connection adapter fastening arrangement 121.4 shown at the outside left in FIG. 9 the ninth post connection adapter 40.9 and the tenth post connection adapter 40.10 are fastened to the beam 24 in such a way that the wide fastening-body parts 119.2 thereof face in opposite directions away from one another and that the two post connection adapters 40.9 and 40.10 are respectively fastened by way of their respective first fastening-body bores 87.1 by means of a respective bolt 64 to associated beam fastening bores 39 which as considered in the direction of the respective longitudinal rows 41.1, 41.2 thereof are arranged to be offset relative to one another by seven beam fastening bores 39, which thus have a seventh overall bore spacing 122.7 of 7×100 millimetres=700 millimetres from one another. As a result, the two post connection body axes 86 of the ninth post connection adapter 40.9 and the tenth post connection adapter 40.10 have a mutual seventh post connection body axial spacing 120.7 similarly of 732 millimetres.

A scaffolding bar 73.2 is detachably fixed by way of its connecting heads 79 by means of a respective wedge 80 to the apertured disc 78 of the ninth post connection adapter 40.9 and to the apertured disc 78 of the tenth post connection adapter 40.10. The length of this scaffolding bar 73.2 is formed to be matched to a first post axial spacing of 732 millimetres. A short scaffolding post 72.2 is plugged onto the tube connector 94 of the post connection body 85 of the tenth post connection adapter 40.10 and is of the same configuration as the short scaffolding post 72.2 of the first post connection adapter fastening arrangement 121.1 shown in FIG. 7. A diagonal 76.3 is detachably fixed by way of the connecting heads thereof by means of a respective wedge 80 to the apertured disc 78 of the ninth post connection adapter 40.9 and to the upper apertured disc 78 of the short scaffolding post 72.2.

In addition, two further post connection adapters, namely an eleventh post connection adapter 40.11 and a twelfth post connection adapter 40.12, are fastened to the same beam 24.

The eleventh post connection adapter 40.11 together with the tenth post connection adapter 40.10 forms an eighth post connection adapter fastening arrangement 121.8. The eleventh post connection adapter 40.11 is fastened to the beam 24 in such a way that the wide fastening-body part 119.2 thereof faces in the same direction as the wide fastening-body part 119.2 of the tenth post connection adapter 40.10 and that also the eleventh post connection adapter 40.11 is fastened by way of its respective first fastening-body bores 87.1 by means of bolts 64 at associated beam fastening bores 39 which are arranged to be offset by ten beam fastening bores 39 relative to those beam fastening bores 39 at which the first fastening-body bores 87.1 of the tenth post connection adapter 40.10 are fastened by means of bolts 64. These beam fastening bores 39 thus have a eighth overall bore spacing 122.8 of 10×100 millimetres=1000 millimetres from one another. As a result, the two post connection body axes 86 of the tenth post connection adapter 40.10 and the eleventh post connection adapter 40.11 have a mutual eighth post connection body axial spacing 120.8 similarly of 1000 millimetres.

The twelfth post connection adapter 40.12 together with the eleventh post connection adapter 40.11 forms a ninth post connection adapter fastening arrangement 121.9. The twelfth post connection adapter 40.12 is in turn fastened to the beam 24 in such a way that the wide fastening-body part 119.2 thereof faces in the same direction as the wide fastening-body part 119.2 of the eleventh post connection adapter 40.11 and that also the twelfth post connection adapter 40.12 is fastened by way of its respective first fastening-body bores 87.1 by means of bolts 64 at associated beam fastening bores 39 which are arranged to be offset by ten beam fastening bores 39 relative to those beam fastening bores 39 at which the first fastening-body bores 87.1 of the eleventh post connection adapter 40.11 are fastened by means of bolts 64. These beam fastening bores 39 thus similarly have a ninth overall bore spacing 122.9 of 10×100 millimetres=1000 millimetres from one another. As a result, the two post connection body axes 86 of the eleventh post connection adapter 40.11 and the twelfth post connection adapter 40.12 have a mutual ninth post connection body axial spacing 120.9 similarly of 1000 millimetres.

REFERENCE NUMERAL LIST

20 scaffolding/hanging scaffolding
21.1 hanging device
21.2 hanging device
22 support device
23 fastening device/suspension shoe
24 beam/U-section beam
24.1 beam/U-section beam
24.2 beam/U-section beam
25 threaded rod
26 threaded rod end
27 support plate
28.1 (first) side plate
28.2 (second) side plate
29 support plate
30 receiving space
31 U profile member of 24
32 suspension hook/U claw
33.1 (first) support limb
33.2 (second) support limb
34 U-section beam longitudinal axis
35 lower wall of 24
36.1 (first) side wall of 24
36.2 (second) side wall of 24
37 transverse spacing/side wall spacing/width of 24
38 transverse wall of 24
39 beam fastening means/beam fastening bore
40 post connection adapter

40.1 post connection adapter
40.2 post connection adapter
40.3 post connection adapter
40.4 post connection adapter
40.5 post connection adapter
40.6 post connection adapter
40.7 post connection adapter
40.8 post connection adapter
40.9 post connection adapter
40.10 post connection adapter
40.11 post connection adapter
40.12 post connection adapter
41.1 (first) longitudinal row
41.2 (second) longitudinal row
42 (height) spacing
43 beam fastening position spacing/bore spacing
44 scaffolding floor
45 cavity profile member of 24
46 longitudinal centre plane of 24
47 cavity profile member width
48 cavity profile member height
49 longitudinal centre plane of 31
50.1 support edge of 33.1
50.2 support edge of 33.2
51 guiding and fastening groove
52 longitudinal axis of 51
53.1 (first) groove engagement-behind web
53.2 (second) groove engagement-behind web
54.1 end of 53.1
54.2 end of 53.2
55 longitudinal slot
56 locking space
58 guide groove
59 U profile member beam height
61 longitudinal centre plane of 58
62 groove base of 58
63 transverse wall part of 38
64 fastening means/connecting body/bolt
65 support connecting device
69 cavity
70 anti-lift-out device
72.1 scaffolding post
72.2 scaffolding post
73.1 scaffolding bar/transverse bar
73.2 scaffolding bar/longitudinal bar
73.3 scaffolding bar/diagonal bar
76.1 diagonal
76.2 diagonal
76.3 diagonal
77.1 post axis of 72.1
77.2 post axis of 72.2
78 apertured disc
79 connecting head
80 wedge
82 (system) axial spacing
85 post connection body
86 posts connection body axis
87.1 (first) fastening-body fastening means/(first) fastening-body bore
87.2 (second) fastening-body fastening means/(second) fastening-body bore
88.1 (first) fastening-body fastening position plane
88.2 (second) fastening-body fastening position plane
89 connecting tube
90 fastening body
91 post connection body end
92.1 passage hole of 78
92.2 passage hole of 78
93 apertured disc spacing
94 tube connector
95 tube connector axis
96 U profile member
97.1 U profile member limb/plate
97.2 U profile member limb/plate
98 base body
99.1 (free) U profile member limb end of 97.1
99.2 (free) U profile member limb end of 97.2
100 tube
101 plate width
102 tube axis of 100
103 centre plane of symmetry of 96
104 limb spacing
105.1 stiffening body
105.2 stiffening body
106.1 (first) fastening-body fastening position/bore centre point of 87.1
106.2 (second) fastening-body fastening position/bore centre point of 87.2
107.1 (first) straight line
107.2 (second) straight line
108 (fastening position) spacing
109 centre plane
110 post connection body axial plane
111 centre point
112 spacing
113.1 (third) straight line
113.2 (fourth) straight line
114.1 (first) spacing
114.2 (second) spacing
115 beam fastening position/bore centre point of 39
116.1 (first) spacing direction
116.2 (second) spacing direction
117 (first) spacing
118 (second) spacing
119.1 (first) narrow fastening-body part
119.2 (second) wide fastening-body part
120 post connection body axial spacing
120.1 post connection body axial spacing
120.2 post connection body axial spacing
120.3 post connection body axial spacing
120.4 post connection body axial spacing
120.5 post connection body axial spacing
120.6 post connection body axial spacing
120.7 post connection body axial spacing
120.8 post connection body axial spacing
120.9 post connection body axial spacing
121 device/post connection adapter fastening arrangement
121.1 device/post connection adapter fastening arrangement
121.2 device/post connection adapter fastening arrangement
121.3 device/post connection adapter fastening arrangement
121.4 device/post connection adapter fastening arrangement
121.5 device/post connection adapter fastening arrangement
121.6 device/post connection adapter fastening arrangement
121.7 device/post connection adapter fastening arrangement
121.8 device/post connection adapter fastening arrangement

121.9 device/post connection adapter fastening arrangement
122 fastening position spacing/total bore spacing
122.1 fastening position spacing/total bore spacing
122.2 fastening position spacing/total bore spacing
122.3 fastening position spacing/total bore spacing
122.4 fastening position spacing/total bore spacing
122.5 fastening position spacing/total bore spacing
122.6 fastening position spacing/total bore spacing
122.7 fastening position spacing/total bore spacing
122.8 fastening position spacing/total bore spacing
122.9 fastening position spacing/total bore spacing
142 fastening-body fastening means spacing

The invention claimed is:

1. A device for detachable fastening of posts (72.1, 72.2) for scaffolding (20) of a scaffolding system, the parallel post axes (77.1, 77.2) of which are arranged or to be arranged at mutual system axial spacings (82) of the scaffolding system, comprising a beam (24) which has a plurality of beam fastening positions (115), which are arranged at the same beam fastening-position spacings (43) from one another of 100 millimeters or a whole-number multiple of 100 millimeters, of beam fastening means (39); and comprising a first post connection adapter (40; 40.1, 40.5, 40.6, 40.9) for detachable fastening of a post (72.1, 72.2) for a scaffolding to the beam (24) and a second post connection adapter (40; 40.2, 40.6, 40.7, 40.10) for detachable fastening of a post (72.1, 72.2) for a scaffolding to the beam (24), which is of the same configuration as the first post connection adapter (40; 40.1, 40.4, 40.5, 40.9);

wherein each post connection adapter (40; 40.1, 40.2, 40.5, 40.6, 40.7, 40.9, 40.10) comprises a fastening body (90):

which at a first fastening-body fastening position (106.1) has a first fastening-body fastening means (87.1) for detachable fastening of the fastening body (90) at a beam fastening position (115) of the beam fastening positions (115) of a beam fastening means (39) of the beam fastening means (39) of the beam (24), and which at a second fastening-body fastening position (106.2) has a second fastening-body fastening means (87.2) for detachable fastening of the fastening body (90) at a beam fastening position (115) of the beam fastening positions (115) of a beam fastening means (39) of the beam fastening means (39) of the beam (24), and which is detachably fastenable or to be detachably fastened to the beam (24) selectably either by way of the first fastening-body fastening means (87.1) or by way of the second fastening-body fastening means (87.2) at a beam fastening position (115) of the beam fastening positions (115) of the beam (24); and wherein each post connection adapter (40; 40.1, 40.2, 40.5, 40.6, 40.7, 40.9, 40.10) comprises a post connection body (85) for detachable fastening of the respective post (72.1, 72.2) for a scaffolding, which is rigidly fastened to its the fastening body (90) and extends in the direction of a post connection body axis (86) of the post connection body (85) and which has a post connection body end (91) extending away from the fastening body (90) and is formed with a tube (100) or constructed as a tube (100), the tube (100) having a tube axis (102) which is aligned with the post connection body axis (86); and wherein the first fastening-body fastening position (87.1) and the second fastening-body fastening position (87.2) have a mutual fastening position spacing (108) of 72 millimeters; and wherein a notional center plane (109), which contains a notional center point (111) in the center between the first fastening-body fastening position (106.1) and the second fastening-body fastening position (106.2), is arranged to be offset at a spacing (112) of 20 millimeters with respect to a notional post connection body axial plane (110), which extends parallel to the notional center plane (109) and contains the post connection body axis (86), as considered in a direction perpendicular to the notional center plane (109) and perpendicular to the post connection body axis (86); and wherein each post connection adapter (40; 40.1, 40.2, 40.5, 40.6, 40.7, 40.9, 40.10) is selectably detachably fastened by way of at least one fastening-body fastening means (87.1, 87.2) of its fastening-body fastening means (87.1, 87.2) of its fastening body (90) in each instance at another beam fastening position (115) of the beam fastening positions (115) of the beam (24) as follows:

a) by way of the first fastening-body fastening means (87.1) of the first post connection adapter (40.9) and by way of the first fastening-body fastening means (87.1) of the second post connection adapter (40.10) in such a way that the post connection body axis (86) of the first post connection adapter (40.9) and the post connection body axis (86), which extends parallel thereto, of the second post connection adapter (40.10) have a mutual post connection body axial spacing (120.7) which is larger by 32 millimeters or smaller by 32 millimeters than a fastening-position spacing (1227) of the first fastening-body fastening position (106.1) of the first fastening-body fastening means (87.1) of the first post connection adapter (40.9) from the first fastening-body fastening position (106.1) of the first fastening-body fastening means (87.1) of the second post connection adapter (40.10);

or b) by way of the second fastening-body fastening means of the first post connection adapter (40; 40.1, 40.5) and by way of the second fastening-body fastening means of the second post connection adapter (40; 40.2, 40.6) in such a way that the post connection body axis of the first post connection adapter (40; 40.1, 40.5) and the post connection body axis, which extends parallel thereto, of the second post connection adapter (40; 40.2, 40.6) have a mutual post connection body axial spacing (120; 120.1, 120.4) which is larger by 112 millimeters or smaller by 112 millimeters than a fastening-position spacing (122, 122.4) of the second fastening-body fastening position (106.2) of the second fastening-body fastening means (87.2) of the first post connection adapter (40; 40.1, 40.5) from the second fastening-body fastening position (106.2) of the second fastening-body fastening means (87.2) of the second post connection adapter (40;40.2, 40.6);

or c) by way of the first fastening-body fastening means of the first post connection adapter and by way of the second fastening-body fastening means of the second post connection adapter in such a way that the post connection body axis of the first post connection adapter and the post connection body axis, which extends parallel thereto, of the second post connection adapter have a mutual post connection body axial spacing which is larger by 72 millimeters or smaller by 72 millimeters than a fastening-position spacing of the first fastening-body fastening position of the first fastening-body fastening means of the first post connection adapter from the second fastening-body fastening position of the second fastening-body fastening means of the second post connection adapter, or by way of the first fastening-body fastening means (87.1) of the second post connection adapter (40.7) and by way of the second fastening-body fastening means (87.2) of the first post connection adapter (40.6) in such a way that the post connection body axis (86) of the first post connection adapter (40.6) and the post connection body axis (86), which extends parallel thereto, of the second post connection adapter (40.7) have a mutual post connection body axial spacing which is larger by 72 millimeters or smaller by 72 millimeters than a fastening-position spacing (122.5) of the second fastening-body fastening position (106.2) of the second fastening-body fastening means (87.2) of the first post connection adapter (40.6) from the first fastening-body fastening position (106.1) of the first fastening-body fastening means (87.1) of the second post connection adapter (40.7);

or d) by way of the first fastening-body fastening means of the first post connection adapter and by way of the second fastening-body fastening means of the second post connection adapter in such a way that the post connection body axis of the first post connection adapter and the post connection body axis, which extends parallel thereto, of the second post connection adapter have a mutual post connection body axial spacing which is larger by 40 millimeters or smaller by 40 millimeters than a fastening-position spacing of the first fastening-body fastening position of the first fastening-body fastening means of the first post connection adapter from the second fastening-body fastening position of the second fastening-body fastening means of the second post connection adapter, or by way of the first fastening-body fastening means of the second post connection adapter and by way of the second fastening-body fastening means of the first post connection adapter in such a way that the post connection body axis of the first post connection adapter and the post connection body axis, which extends parallel thereto, of the second post connection adapter have a mutual post connection body axial spacing which is larger by 40 millimeters or smaller by 40 millimeters than a fastening-position spacing of the second fastening-body fastening position of the second fastening-body fastening means of the first post connection adapter from the first fastening-body fastening position of the first fastening-body fastening means of the second post connection adapter.

2. The device according to claim 1, wherein the fastening body (90) of each post connection adapter (40; 40.1, 40.2, 40.5, 40.6, 40.7, 40.9, 40.10) has at a further first fastening-body fastening position (106.1) a further first fastening-body fastening means (87.1) for detachable fastening of the fastening body (90) at a beam fastening position (115) of a beam fastening means (39) of the beam fastening means (39) of the beam (24), wherein the further first fastening-body fastening position (106.1) of the further first fastening-body fastening means (87.2) and the first fastening-body fastening position (106.1) of the first fastening-body fastening means (87.1) as considered in the direction of the post connection body axis (86) are arranged at a first fastening-body fastening means spacing (142) from one another and each in a notional first fastening-body fastening position plane (88.1) extending parallelly to the notional center plane (109);

and in the case of each post connection adapter (40; 40.1, 40.2, 40.5, 40.6, 40.7, 40.9, 40.10) the fastening body (90) has at a further second fastening-body fastening position (106.2) a further second fastening-body fastening means (87.2) for detachable fastening of the fastening body (90) at a beam fastening position (115) of a beam fastening means (39) of the beam fastening means (39) of the beam (24), wherein the further second fastening-body fastening position (106.2) of the further second fastening-body fastening means (87.2) and the second fastening-body fastening position (106.2) of the second fastening-body fastening means (87.2) as considered in the direction of the post connection body axis (86) are arranged at a second fastening-body fastening means spacing (142) from one another and each in a notional second fastening-body fastening position plane (88.2) extending parallel to the notional center plane (109), wherein the second fastening-body fastening means spacing (142) is the same size as the first fastening-body fastening means spacing (142).

3. The device according to claim 2, wherein the beam fastening means (39) are arranged in parallel longitudinal rows (41.1, 41.2) each along a notional straight line, which rows have a mutual longitudinal row spacing (42) the same size as the first fastening-body fastening means spacing (142) and the second fastening-body fastening means spacing (142).

4. The device according to claim 1, wherein the fastening body (90) of each post connection adapter (40; 40.1, 40.2, 40.5, 40.6, 40.7, 40.9, 40.10) is formed by a U profile member (96), which is open in a direction away from the post connection body end (91) and the parallel U profile member limbs (97.1, 97.2) of which have a mutual limb spacing (104) as considered in a direction perpendicular to the post connection body axis (86), and that a first U profile member limb (97.1) of the U profile member limbs (97.1, 97.2) include the first fastening-body fastening means (87.1) and the second fastening-body fastening means (87.2) or the at least two first fastening-body fastening means (87.1, 87.1) and the at least two second fastening-body fastening means (87.2, 87.2) and that a second U profile member limb (97.2) of the U profile member limbs (97.1, 97.2) includes corresponding or the same fastening-body fastening means (87.1, 87.2) at corresponding or the same fastening-body fastening positions (106.1, 106.2).

5. The device according to claim 1, wherein a rosette or apertured disc (78), which surrounds the outer circumference of the tube (100) at least partly or entirely, for detachable connection of scaffolding components is fastened to the tube (100) of the post connection body (85) of each post connection adapter (40; 40.1, 40.2, 40.5, 40.6, 40.7, 40.9, 40.10).

6. The device according to claim 1, wherein the post connection body (85) of each post connection adapter (40; 40.1, 40.2, 40.5, 40.6, 40.7, 40.9, 40.10) comprises a tube connector (94) for insertion or plugging-on of the post (72.1, 72.2) for scaffolding (20), wherein the tube connector (94) has a tube connector axis (95) aligned with the post connection body axis (86) and extends in the direction of its the tube connector axis (95) up to the post connection body end (91).

7. The device according to claim 1, wherein the or each first fastening-body fastening means (87.1) of each post connection adapter (40; 40.1, 40.2, 40.5, 40.6, 40.7, 40.9, 40.10) and the or each second fastening-body fastening means (87.2) of each post connection adapter (40; 40.1, 40.2, 40.5, 40.6, 40.7, 40.9, 40.10) are of the same configuration.

8. The device according to claim 1, wherein the respective or each first fastening-body fastening means (87.1) of each post connection adapter (40; 40.1, 40.2, 40.5, 40.6, 40.7, 40.9, 40.10) and the respective or each second fastening-body fastening means (87.2) of each post connection adapter (40; 40.1, 40.2, 40.5, 40.6, 40.7, 40.9, 40.10) is a passage or a bore.

9. The device according to claim 1, wherein the beam fastening means (39) are passages or bores.

10. The device according to claim 1, wherein the beam fastening means (39) have the same configuration as the fastening-body fastening means (87.1, 87.2).

11. The device according to claim 1, wherein the beam (24) has parallel side walls (36.1, 36.2) which have a mutual side wall spacing (37) and that the fastening body of the first post connection adapter (40; 40.1, 40.4, 40.6, 40.9) and the second post connection adapter (40; 40.2, 40.5, 40.7, 40.10) are each formed with a U profile member (96) which is open in a direction away from the post connection body end (91) and the parallel U profile member limbs (97.1, 97.2) of which as considered in a direction perpendicular to the post connection body axis (86) have a mutual limb spacing (104) of the same size, which is slightly larger than the side wall spacing (37) of the beam (24), and that each post connection adapter (40; 40.1, 40.2, 40.4, 40.5, 40.6, 40.7, 40.9, 40.10) is plugged by its U profile member (96) onto the beam (24) and detachably fastened by way of its fastening-body fastening means (87.1, 87.2) to the beam (24) by way of associated beam fastening means (39) of the beam fastening means (39).

12. The device according to claim 1, wherein each fastening-body fastening means (87.1, 87.2) is detachably connected with the associated beam fastening means (39) by way of a connecting body (64).

* * * * *